US011421454B2

(12) United States Patent
Cumbo et al.

(10) Patent No.: US 11,421,454 B2
(45) Date of Patent: Aug. 23, 2022

(54) CLOSURE LATCH ASSEMBLY WITH LATCH MECHANISM AND OUTSIDE RELEASE MECHANISM HAVING RESET DEVICE

(71) Applicant: Magna Closures Inc., Newmarket (CA)

(72) Inventors: Francesco Cumbo, Pisa (IT); Marco Taurasi, Leghorn (IT)

(73) Assignee: MAGNA CLOSURES INC., Newmarket (CA)

( * ) Notice: Subject to any disclaimer, the term of this patent is extended or adjusted under 35 U.S.C. 154(b) by 996 days.

(21) Appl. No.: 15/997,037

(22) Filed: Jun. 4, 2018

(65) Prior Publication Data

US 2018/0355642 A1 Dec. 13, 2018

Related U.S. Application Data

(60) Provisional application No. 62/516,346, filed on Jun. 7, 2017.

(51) Int. Cl.

| | |
|---|---|
| ***E05B 81/90*** | (2014.01) |
| ***E05B 85/00*** | (2014.01) |
| ***E05B 81/14*** | (2014.01) |
| ***E05B 77/30*** | (2014.01) |
| ***E05B 83/36*** | (2014.01) |

(Continued)

(52) U.S. Cl.

CPC ..... *E05B 81/90* (2013.01); *E05B 77/30* (2013.01); *E05B 81/14* (2013.01); *E05B 83/36* (2013.01); *E05B 85/01* (2013.01); *E05B 85/06* (2013.01); *E05B 81/06* (2013.01)

(58) Field of Classification Search

CPC ..... E05B 81/02; E05B 81/06; E05B 81/14; E05B 81/90; E05B 77/14; E05B 77/16; E05B 83/36; E05B 85/01; E05B 85/06; E05B 85/20; E05B 85/24; E05B 85/243; E05B 85/26; Y10T 292/1047; Y10T 292/1053; Y10T 292/1055;

(Continued)

(56) References Cited

U.S. PATENT DOCUMENTS

| | | | |
|---|---|---|---|
| 5,634,677 | A | 6/1997 | Buscher et al. |
| 6,863,318 | B2 | 3/2005 | Mejean et al. |

(Continued)

FOREIGN PATENT DOCUMENTS

| | | | |
|---|---|---|---|
| CN | 1993530 | A | 7/2007 |
| CN | 101109248 | A | 1/2008 |

(Continued)

*Primary Examiner* — Christine M Mills
*Assistant Examiner* — Christopher F Callahan
(74) *Attorney, Agent, or Firm* — Dickinson Wright PLLC

(57) ABSTRACT

A closure latch assembly for a motor vehicle closure system having a latch mechanism, a latch release mechanism for releasing the latch mechanism, and an outside backup release mechanism operable, in cooperating with the latch mechanism and the latch release mechanism, to provide an external latch release function and a separate and distinct latch reset function. The external latch release function is initiated by a first-key actuation operation associated with a door-mounted key release mechanism. The latch reset function is initiated, after the external latch release function, via a second key-actuated operation associated with a reset device on the closure latch assembly.

22 Claims, 18 Drawing Sheets

(51) Int. Cl.
*E05B 85/06* (2014.01)
*E05B 81/06* (2014.01)

(58) Field of Classification Search
CPC ..... Y10T 292/1076; Y10T 292/1078; Y10T 292/1082; Y10S 292/23; Y10S 292/25
See application file for complete search history.

(56) References Cited

U.S. PATENT DOCUMENTS

| | | | | |
|---|---|---|---|---|
| 9,476,230 | B2 * | 10/2016 | Margheritti | E05B 77/16 |
| 10,287,806 | B2 | 5/2019 | Mizuno et al. | |
| 2004/0245786 | A1 | 12/2004 | Hashiba et al. | |
| 2009/0236863 | A1 | 9/2009 | Akizuki et al. | |
| 2011/0204673 | A1 | 8/2011 | Cumbo et al. | |

FOREIGN PATENT DOCUMENTS

| | | | | |
|---|---|---|---|---|
| CN | 102482898 | A | 5/2012 | |
| CN | 104818909 | A | 8/2015 | |
| CN | 107407110 | A | 11/2017 | |
| EP | 0393595 | A2 * | 10/1990 | E05B 81/20 |
| WO | WO-2011010553 | A1 * | 1/2011 | E05B 85/06 |
| WO | WO-2011094834 | A1 * | 8/2011 | E05B 81/70 |
| WO | 2012163503 | A1 | 12/2012 | |
| WO | WO-2013102838 | A1 * | 7/2013 | E05B 81/06 |

* cited by examiner

CLOSURE LATCH ASSEMBLY WITH LATCH MECHANISM AND OUTSIDE RELEASE MECHANISM HAVING RESET DEVICE

CROSS-REFERENCE TO RELATED APPLICATION

This application claims the benefit of U.S. Provisional Application Ser. No. 62/516,346, filed Jun. 7, 2017, which is incorporated herein by reference in its entirety.

FIELD

The present disclosure relates generally to closure latch assemblies for use in motor vehicle closure systems. More specifically, the present disclosure is directed to a closure latch assembly for a vehicle door equipped with a latch mechanism, a latch release mechanism, and an outside backup release mechanism having a manually-operable latch reset function.

BACKGROUND

This section provides background information related to the present disclosure which is not necessarily prior art.

Passive entry systems for vehicles are provided on some vehicles to permit a vehicle user who is in possession of the vehicle key to simply pull the door handle and open the door without the need to introduce the key into a keyhole in the door. The key fob is typically equipped with an electronic device that communicates with the vehicle's on-board control system to authenticate the user. When the user pulls the outside door handle to indicate that he/she wishes entry into the vehicle, an electric actuator of a power release mechanism associated with a door-mounted closure latch assembly is actuated to release a latch mechanism so as to open the door. The outside door handle may also be equipped with a switch, instead of moveable outside door handle that triggers actuation of the electric actuator. In most closure latch assemblies, the latch mechanism may also be manually released from inside the vehicle since the inside door handle is connected to the latch mechanism via an inside handle release mechanism associated with the closure latch assembly. In some jurisdictions, however, there are regulations that govern the degree of connection provided by the inside handle release mechanism between the inside door handle and the latch mechanism (particularly for a rear door, where children may be the occupants).

Many modern closure latch assemblies provide one or more power-operated functions including power release, power lock, power child lock, and power cinch or soft-close features. Loss of power to the closure latch assembly may render such power-operated functions inoperable. To avoid entrapment within the passenger compartment upon loss of the power release function, for example, many closure latch assemblies have an inside "backup" release mechanism that can be activated via the inside door handle to release the latch mechanism and open the vehicle door. In addition, many closure latch assemblies have a key-actuated outside backup release mechanism associated with the outside door handle that is actuated via a first or "releasing" key action to release the latch mechanism and open the vehicle door. In some arrangements, an auto "reset" function is employed which uses the electric actuator to reset the outside backup release mechanism and the latch mechanism for permitting the vehicle door to be subsequently closed and latched. However, without such an auto reset function, the vehicle door cannot be closed until a second or "resetting" key action is completed to reset the latch mechanism. Typically, such backup latch release arrangements are complicated and may not always be intuitive to the vehicle occupant.

Accordingly, while commercially-available powered closure latch assemblies are satisfactory to meet all operational and regulatory requirements, a recognized need exists to advance the technology and provide optimized powered closure latch assemblies having reduced complexity and packaging while providing both the desired power-operated functions and emergency inside release function previously mentioned.

SUMMARY

This section provides a general summary of the disclosure and is not intended to be interpreted as a comprehensive and exhaustive listing of its full scope or all of its aspects, features and structured configurations.

It is an aspect of the present disclosure to provide a closure latch assembly for a vehicle door having a latch mechanism, a latch release mechanism, and an outside backup release mechanism with a manually-actuated latch reset device.

It is a related aspect of the present disclosure to shift the outside backup mechanism from a Rest state to an Engaged state via rotation of an external key cylinder associated with an outside door handle on the vehicle door for causing the latch mechanism to shift from a Closed/Latched mode to an Open/Unlatched mode. A reset knob associated with the outside backup mechanism moves from an unlock position to a lock position for holding a backup lever in a blocked position. Subsequent manual movement of the reset knob from its lock position to its unlock position functions to release the backup lever and allow the latch mechanism and the latch release mechanism to reset and permit closure and latching of the vehicle door.

In a related aspect, the Latch mode for the closure latch assembly is established when the latch mechanism is operating in a Closed state and the outside backup release mechanism is operating in a Rest state. Completion of a manual (i.e., key-actuated) outside latch release operation shifts the latch mechanism into an Open state and shifts the outside backup release mechanism into an Engaged state for shifting the closure latch assembly into an Unlatched-Block mode. The closure latch assembly can subsequently be shifted into an Unlatched-Reset mode by completion of a manual (i.e., key-actuated) latch reset operation for shifting the latch mechanism into a Reset state and returning the outside backup release mechanism to its Rest state. The manual outside latch release operation is initiated by insertion and rotation of a key by the user into a door-mounted key cylinder. The manual reset operation is initiated by insertion and rotation of the key by the user into a reset device on the closure latch assembly and associated with the outside backup release mechanism.

In a further related aspect, the closure latch assembly of the present disclosure comprises: a latch mechanism operable in a Closed state to capture and retain a striker and in an Open state to release the striker; a latch release mechanism operable for selectively shifting the latch mechanism from its Closed state to its Open state; and an outside backup release mechanism operable in a Rest state when the latch mechanism is in its Closed state and shifted into an Engaged state in response to the key-actuated outside latch release operation actuating the latch release mechanism, wherein the outside backup release mechanism is operable in the Engaged state to block return of the latch release mechanism to a Rest state, and wherein the outside backup release mechanism can be shifted from its Engaged state back to its Rest state via the key-actuated latch reset operation.

In accordance with these and other aspects, a closure latch assembly for installation in a vehicle door having an outside handle is provided, comprising: a latch mechanism having a primary ratchet and a primary pawl. The primary ratchet is moveable between a striker capture position whereat the primary ratchet retains a striker and a striker release position whereat the primary ratchet releases the striker. The primary pawl is moveable between a closed position whereat the primary pawl holds the primary ratchet in its striker capture position and an open position whereat the primary pawl is positioned to permit the primary ratchet to move to its striker release position. A latch release mechanism is included having a release lever moveable between a rest position whereat the primary pawl is located in its closed position and an engaged position whereat the release lever moves the primary pawl to its open position. An outside backup release mechanism is provided having an OS backup lever; an OS connection device connecting the OS backup lever to a key cylinder associated with the outside handle, and an OS reset knob. The OS backup lever is moveable between a rest position and an engaged position, while the OS reset knob is moveable between an unlock position permitting the OS backup lever to move to its rest position and a lock position whereat the OS reset knob holds the OS backup lever in its engaged position. A manual latch release operation includes manually actuating the key cylinder to move the OS connection device, thereby causing the OS backup lever to move from its rest position to its engaged position for moving the release lever to its engaged position so as to shift the closure latch assembly from a Latched mode into an Unlatched-Blocked mode, whereat the OS reset knob is in its lock position for blocking movement of the OS backup lever from its engaged position to its rest position and holding the release lever in its engaged position. A manual latch reset operation includes shifting the closure latch assembly from its Unlatched-Blocked mode into an Unlatched-Reset mode. The manual latch reset operation includes manually moving the OS reset knob from its lock position to its unlock position for permitting the OS backup lever to return to its rest position and for permitting the release lever to return to its rest position.

In accordance with a further aspect, the key cylinder can be configured for the insertion and rotation of a key therein for causing the connection device to move the OS backup lever from its rest position to its engaged position.

In accordance with a further aspect, the OS reset knob can be provided with a key interface configured for the insertion and rotation of a key therein for manually rotating the OS reset knob from its lock position to its unlock position.

In accordance with a further aspect, the key interface in the OS reset knob can be located on a shut face portion of the vehicle door.

In accordance with a further aspect, the outside backup release mechanism can be provided having a reset knob biasing member biasing the OS reset knob toward its lock position.

In accordance with a further aspect, the reset knob biasing member can be configured to act on the OS backup lever to bias the OS backup lever toward its rest position.

In accordance with a further aspect, the OS backup lever can be configured having a spring flange on which the reset knob biasing member acts and the OS reset knob can be configured having a blocking lug segment configured to engage the spring flange to maintain the OS reset knob in its unlock position against the bias of the reset knob biasing member.

In accordance with a further aspect, the spring flange can be configured having a blocking edge and the blocking lug segment can be configured having a cam edge such that when the OS reset knob is in its lock position, engagement of the cam edge with the blocking edge releasably maintains the OS backup lever in its engaged position and OS reset knob in its lock position.

In accordance with a further aspect, the manual latch reset operation includes inserting the key into the key interface in the OS reset knob and manually rotating the OS reset knob from its lock position to its unlock position against a bias imparted by the reset knob biasing member and moving the cam edge out of engagement with the blocking edge for permitting the OS backup lever to automatically return to its rest position under a bias imparted by the reset knob biasing member.

In accordance with a further aspect, the latch mechanism can further include a secondary ratchet and a secondary pawl. The secondary ratchet is moveable between an engaged position whereat the secondary ratchet locates the primary pawl in its closed position and a disengaged position whereat the secondary ratchet moves the primary pawl to its open position. The secondary pawl is moveable between a closed position whereat the secondary pawl holds the secondary ratchet in its engaged position and an open position whereat the secondary pawl is located to permit the secondary ratchet to move to its disengaged position. The release lever is configured to engage the secondary pawl and, while the release lever is in the rest position, the secondary pawl is located in its closed position and, while the release lever is in the engaged position, the release lever moves the secondary pawl to its open position.

In accordance with yet a further aspect, a vehicle door having an outside handle and a closure latch assembly is provided. The closure latch assembly includes a latch mechanism having at least one ratchet and at least one pawl. The at least one ratchet is moveable between a striker capture position, whereat the at least one ratchet retains a striker, and a striker release position, whereat the at least one ratchet releases the striker. The at least one pawl is moveable between a closed position, whereat the at least one pawl holds the at least one ratchet in its striker capture position, and an open position, whereat the at least one pawl is positioned to permit the at least one ratchet to move to its striker release position. The closure latch assembly further includes a latch release mechanism having a release lever configured to engage the at least one pawl and being moveable between a rest position, whereat the at least one pawl is located in its closed position, and an engaged position, whereat the release lever moves the at least one pawl to its open position. The closure latch assembly further includes an outside backup release mechanism having an OS backup lever, and OS connection device connecting the OS backup lever to a key cylinder associated with the outside handle, and an OS reset knob. The OS backup lever is moveable between a rest position and an engaged position. The OS reset knob is moveable between an unlock position permitting the OS backup lever to move to its rest position and a lock position, whereat the OS reset knob holds the OS backup lever in its engaged position. A manual latch release operation includes manually actuating the key cylinder to move the OS connection device and causing the OS backup lever to move from its rest position to its engaged position for moving the release lever to its engaged position so as to shift the closure latch assembly from a Latched mode into an Unlatched-Blocked mode with the OS reset knob in its lock position for blocking movement of the OS backup lever from its engaged position to its rest position and holding the release lever in its engaged position. A manual latch reset operation includes shifting the closure latch assembly from its Unlatched-Blocked mode into an Unlatched-Reset mode. The manual latch reset operation includes manually moving the OS reset knob from its lock position to its unlock position for permitting the OS backup lever to return to its rest position and for permitting the release lever to return to its rest position.

BRIEF DESCRIPTION OF THE DRAWINGS

Other advantages of the present disclosure will be readily appreciated, as the same becomes better understood by reference to the following detailed description when considered in connection with the accompanying drawings wherein.

Corresponding reference numerals are used throughout all of the drawings to identity common components.

DETAILED DESCRIPTION OF EXAMPLE EMBODIMENTS

Figure 1:
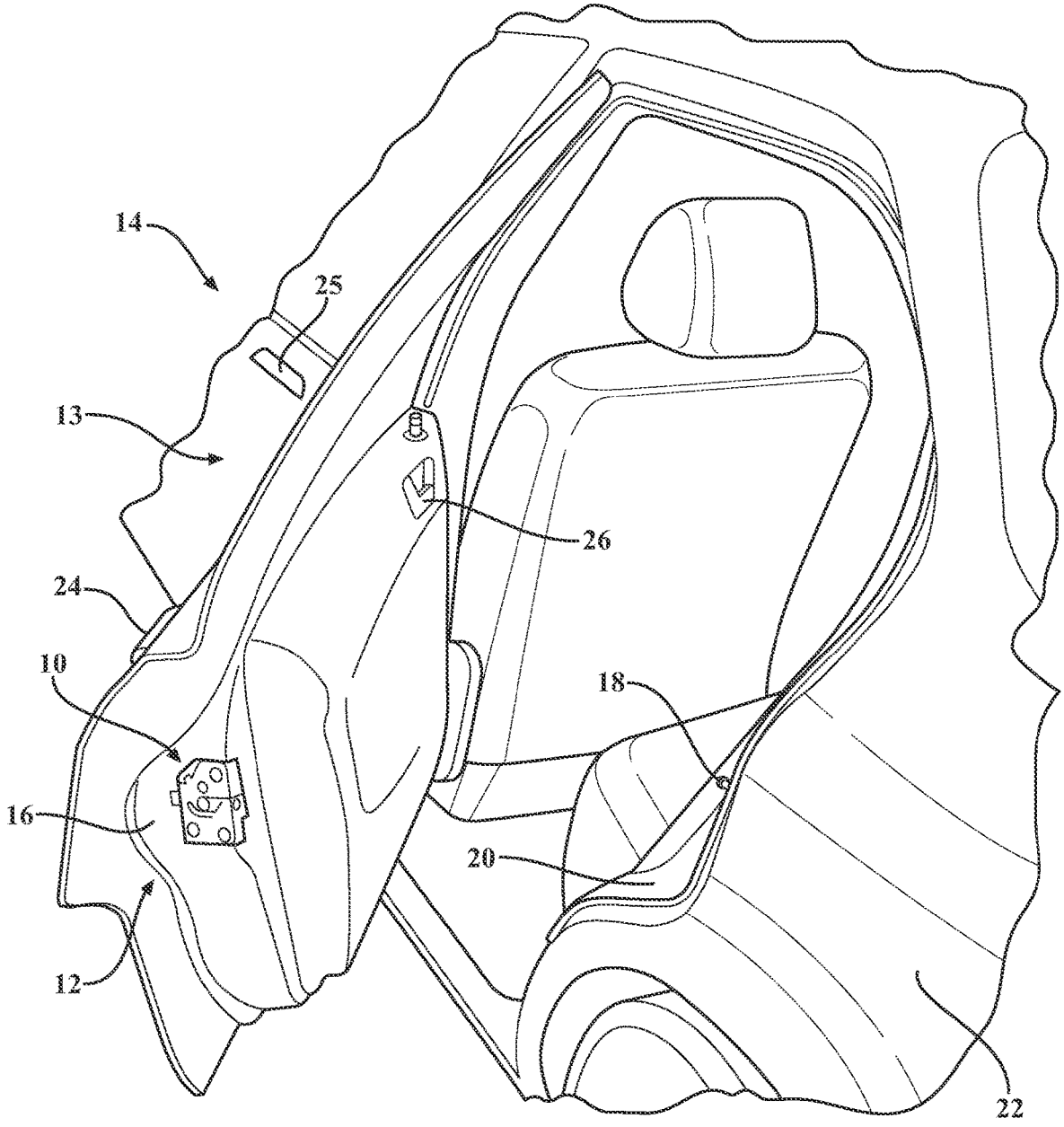
FIGS. 1 and 1A are an isometric views of a vehicle door equipped with a closure latch assembly.

In general, example embodiments of a closure latch for use in motor vehicle door closure systems constructed in accordance with the teachings of the present disclosure will now be disclosed. The example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail, as they will be readily understood by the skilled artisan in view of the disclosure herein.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," "top", "bottom", and the like, may be used herein for ease of description to describe one element's or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated degrees or at other orientations) and the spatially relative descriptions used herein interpreted accordingly.

Referring initially to FIG. 1, a closure latch assembly 10 for a rear door 12 of a motor vehicle 14 is shown positioned along a shut face portion 16 of door 12 and is configured to releaseably engage and capture a striker 18 secured within a door opening 20 formed in a vehicle body 22 in response to movement of door 12 from an open position to a closed position. Door 12 is shown to include an outside door handle 24 and an inside door handle 26, both of which are operatively connected (i.e., electrically and/or mechanically) to closure latch assembly 10. White not shown, it is understood that a similar closure latch assembly is provided in association with a front door 13 of vehicle 14 shown to include its own outside door handle 25.

Figure 1A:
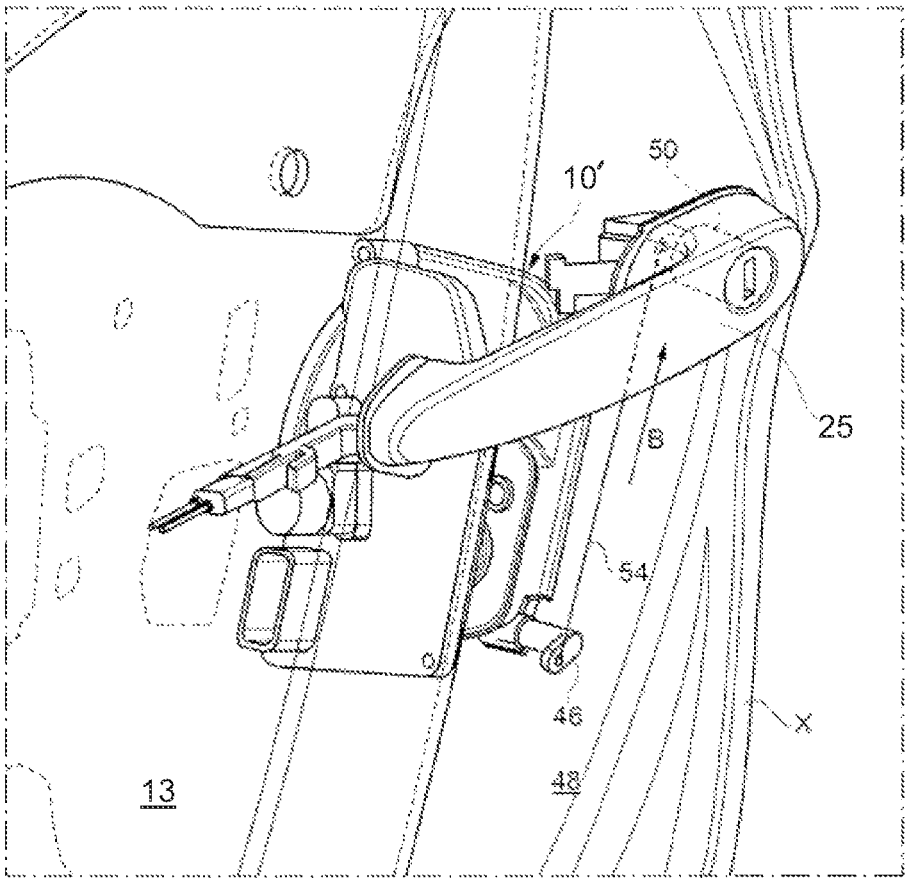
Figure 1B:
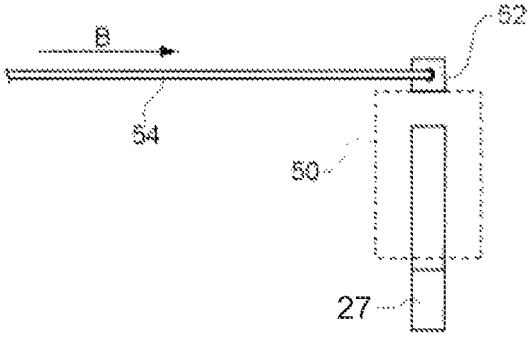
FIG. 1B is a schematic top view of a key cylinder and a key used to provide an outside release function of the door-mounted closure latch assembly shown in FIG. 1A.
Figure 1C:
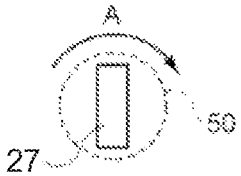
FIG. 1C is a front view of the arrangement shown in FIG. 1B.

FIG. 1A illustrates a closure latch assembly 10' mounted in front door 13 of vehicle 14. An exterior side "X" of front door 13 is shown with front outside door handle 25 accessible from the exterior of vehicle 14. A key cylinder 50 is provided in front door 13 and is mechanically interconnected to a key lever 46 associated with closure latch assembly 10' via a connector device, such as a cable assembly or rod linkage, as indicated by reference number 54. As will be described, manual rotation of key cylinder 50 via a key 27 in a first or "releasing" direction (arrow "A" in FIG. 1C) operates to move key lever 46 from a non-actuated position to an actuated position for releasing a latch mechanism associated with closure latch assembly 10', thereby allowing front door 13 to be released for movement to its open position. As shown in FIG. 1B, key cylinder 50 preferably has a linkage element 52 operably connected to connector device 54 and which functions to convert rotation of key cylinder 50 into translational movement (arrow "B") of connector device 54.

Figure 2A:
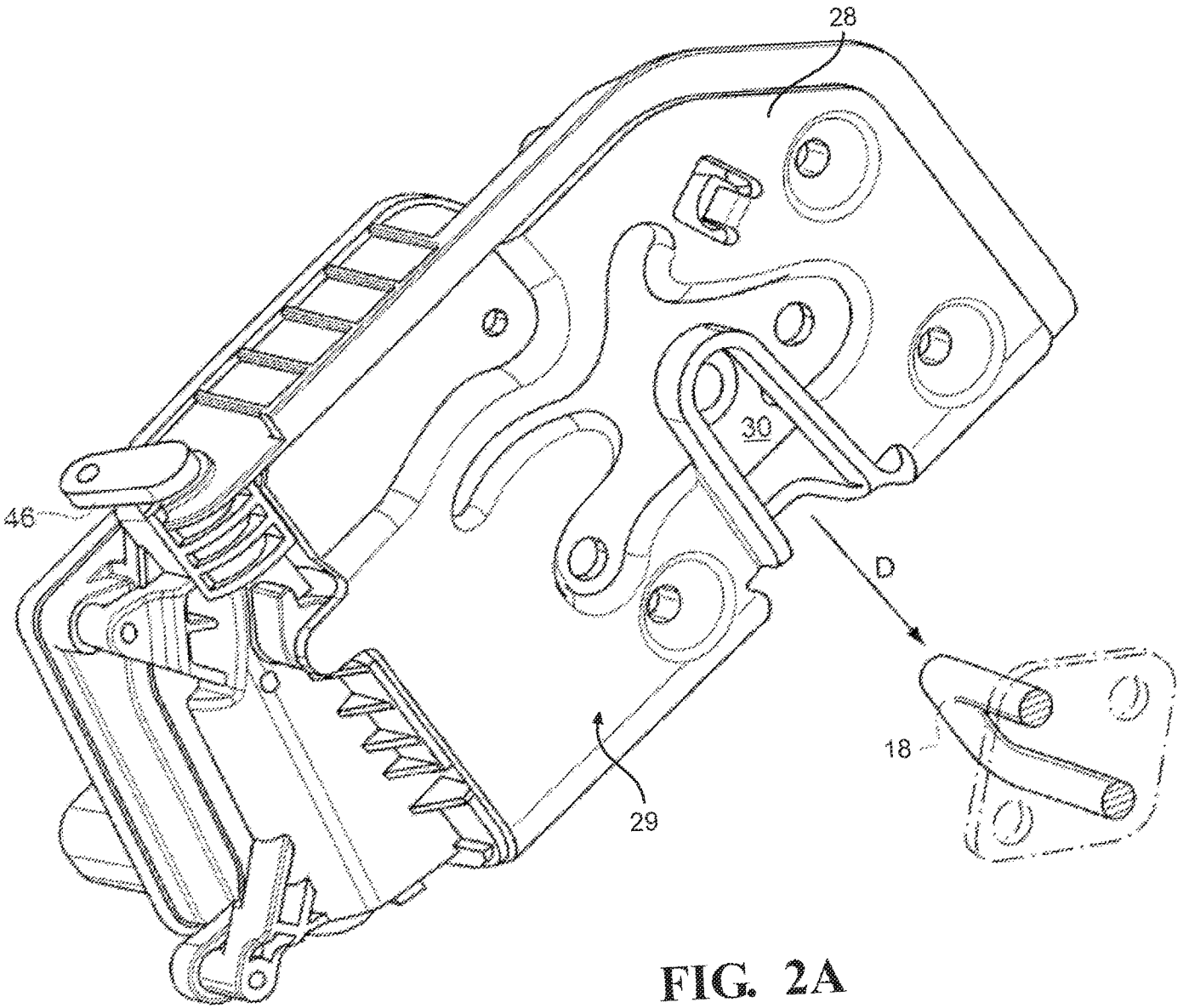
FIG. 2A is an isometric view of the closure latch assembly shown in FIGS. 1 and/or 1A.
Figure 2B:
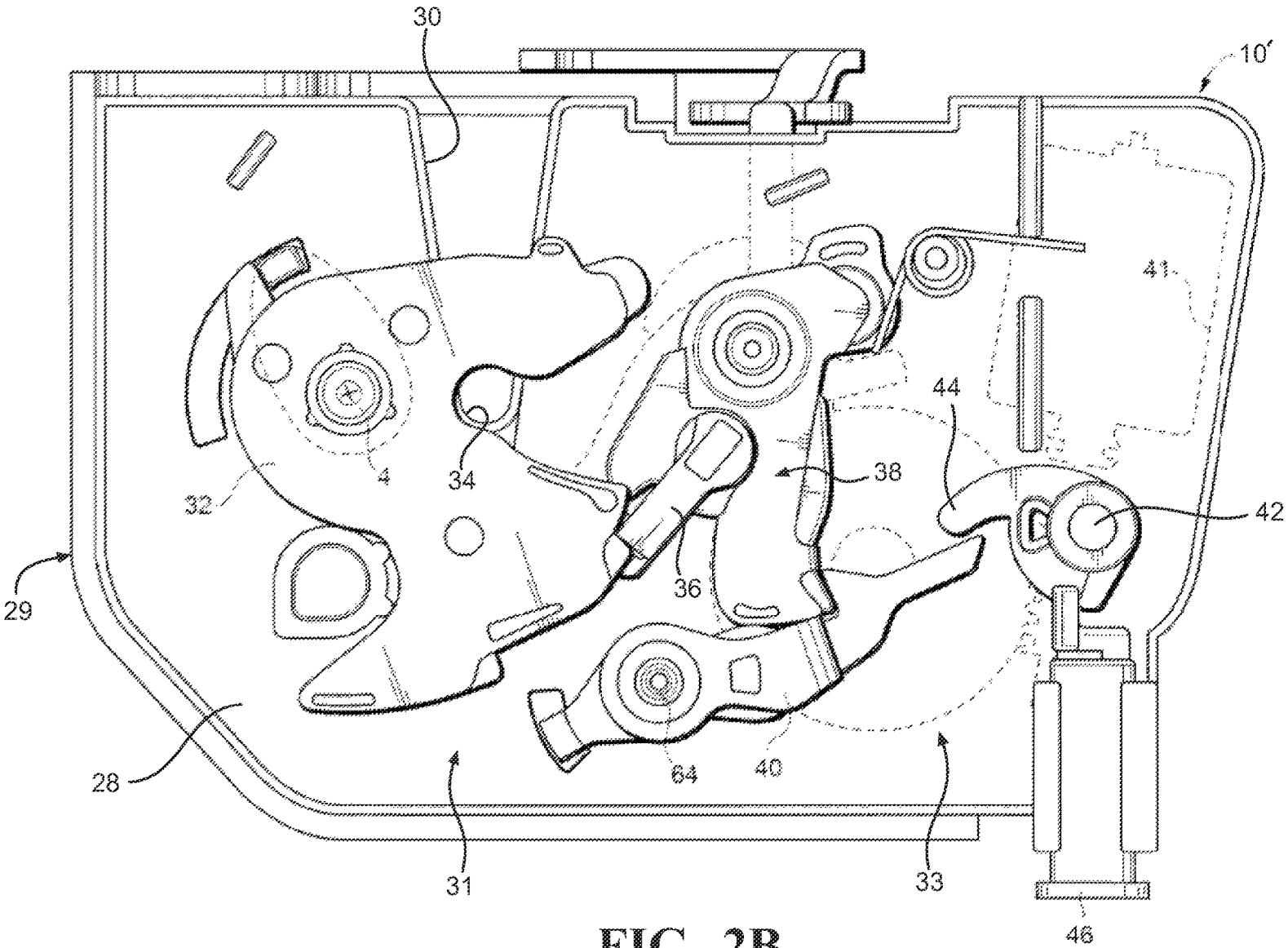
FIG. 2B is a front-side plan view of the closure latch assembly shown in FIG. 2A with a front cover plate removed to better illustrate components of a latch mechanism, a power release mechanism, and an outside backup release mechanism.
Figure 2C:
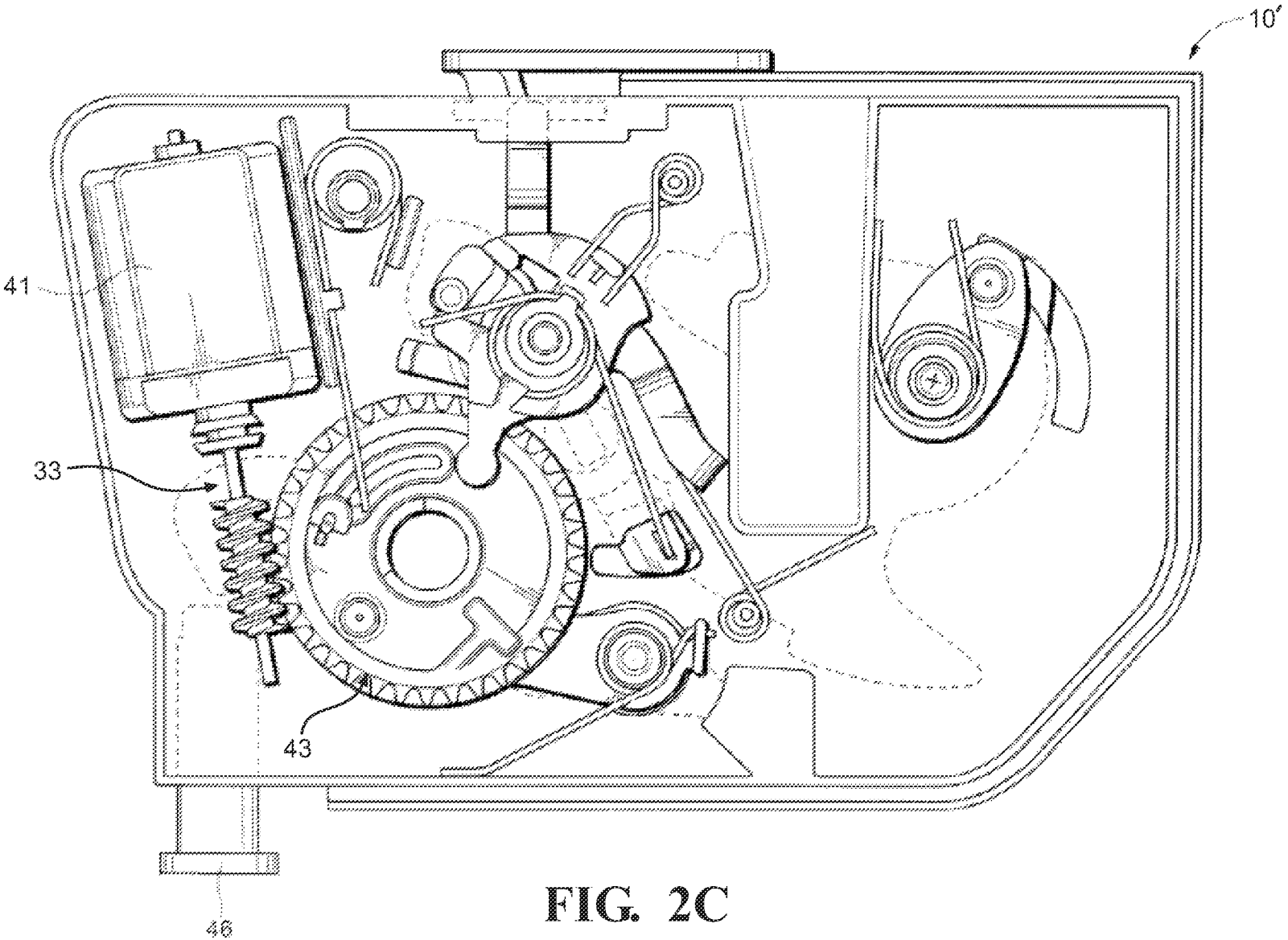
FIG. 2C is a rear-side plan view of the closure latch assembly shown in FIG. 2A with a rear cover plate removed to further illustrate the various components.
Figure 3:
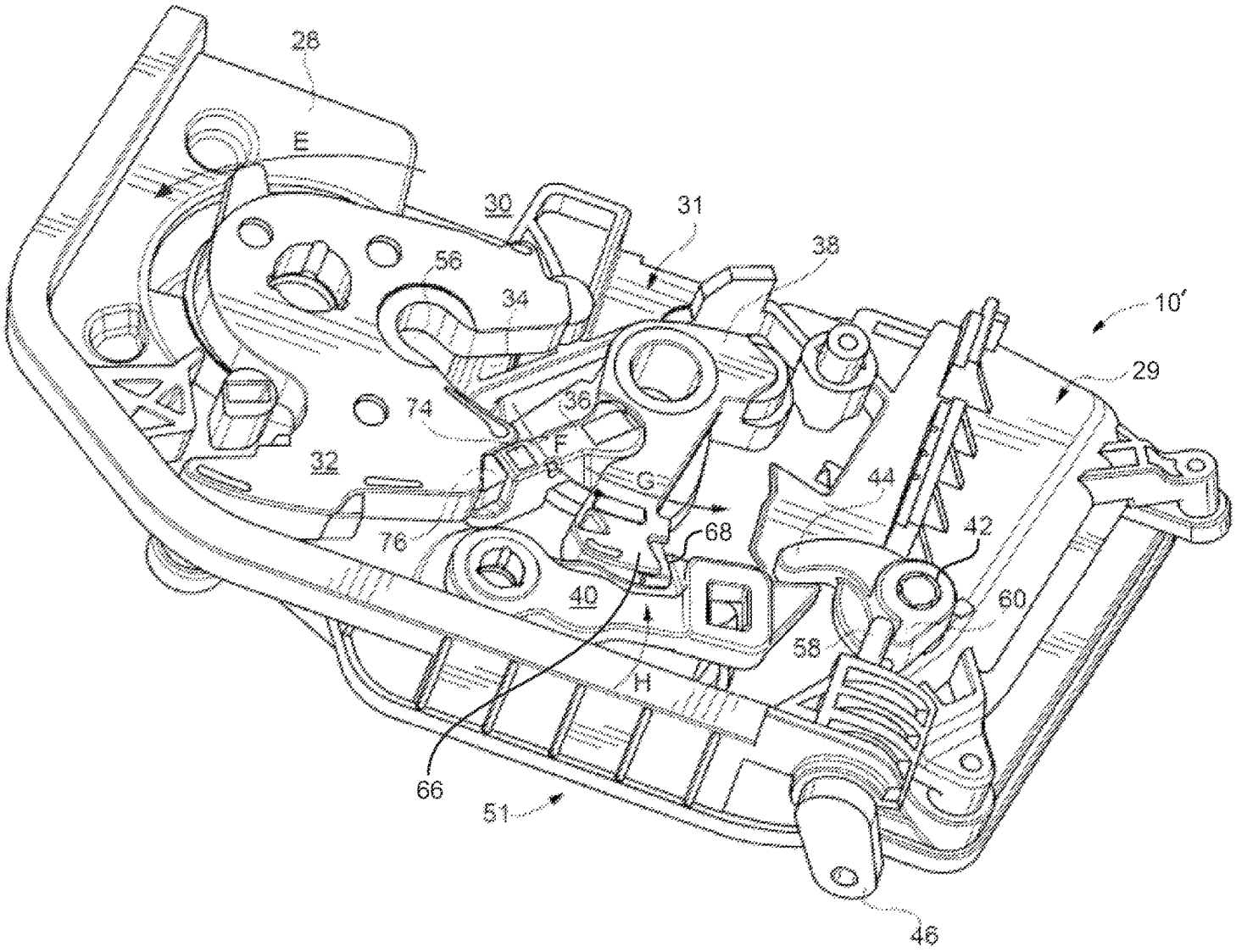
FIG. 3 is a front-side isometric view of the closure latch assembly shown in FIG. 2A operating in a Latched mode.

Referring now to FIGS. 2-5, a non-limiting example embodiment of closure latch assembly 10' is shown to generally include a latch mechanism 31, a power latch release mechanism 33, and an outside backup release mechanism 35. Latch mechanism 31 is shown as a double pawl-double ratchet configuration having a primary ratchet 32, a primary pawl 36, a secondary ratchet 38, and a secondary pawl 40. Primary ratchet 32 is pivotably mounted to a plate segment 28 of a latch housing 29 and has a ratchet slot 34 alignable with a fishmouth slot 30 formed in latch housing 29. Primary ratchet 32 is moveable between a primary closed or "striker capture" position (FIG. 3) whereat striker 18 is held within fishmouth slot 30 by ratchet slot 34, and an open or "striker release" position (FIG. 4) whereat striker 18 is release from ratchet slot 34 and fishmouth slot 30. Primary ratchet 32 is biased by a primary ratchet spring (not shown) toward its striker release position, as indicated by arrow "E" (FIG. 3). Primary pawl 36 is pivotably supported by secondary ratchet 38 for movement between a secured or "closed" position (FIG. 3) whereat primary pawl 36 locates and holds primary ratchet 32 in its striker capture position, and an unsecured or "open" position whereat primary pawl 36 is positioned to permit primary ratchet 32 to move to its striker release position. A primary pawl biasing spring (not shown) is operable to normally bias primary pawl 36 toward its open position, as indicated by arrow "F". Secondary ratchet 38 is pivotably mounted to plate segment 28 of latch housing 29 for movement between a first or "engaged" position (FIG. 3) whereat secondary ratchet 38 holds primary pawl 36 in its closed position and a second or "disengaged" position (FIG. 4) whereat secondary ratchet 38 locates primary pawl 36 in its open position. A secondary ratchet biasing member (not shown) is provided for normally biasing secondary ratchet 38 toward its disengaged position, as indicated by arrow "G". Finally, secondary pawl 40 is pivotably mounted to plate segment 28 for movement between a first or "closed" position (FIG. 3) whereat secondary pawl 40 holds secondary ratchet 38 in its engaged position, and a second or "open" position (FIG. 4) whereat secondary pawl 40 is positioned to permit secondary ratchet 38 to move to its disengaged position. A secondary pawl biasing member (not shown) is provided for normally biasing secondary pawl 40 toward its closed position, as indicated by arrow "H". Those skilled in the art will recognize and appreciate that latch mechanism 31 is not limited to the double ratchet-double pawl arrangement disclosed and is intended to represent any configuration operable to provide a closed/latched state and an open/unlatched state, including, but not limited to, a single ratchet-single pawl arrangement.

Power release mechanism 33 is best shown in FIG. 2C to include an electric motor 41 and a power release gear 43 driven by electric motor 41 which functions to move secondary pawl 40 from its closed position to its open position to provide a power releasing function of latch mechanism 31. Rotation of power release gear 43 in a first or "releasing" direction results in release of latch mechanism 31 and rotation in an opposite or "resetting" direction results in resetting of latch mechanism 31. As is well known, a key fob or actuation of a switch on door handle 25 on door 13 provides a signal to an ECU associated with closure latch assembly 10' indicating a request to release latch mechanism 31. Accordingly, the ECU controls operation of motor 41 to rotate power release gear 43.

Figure 4:
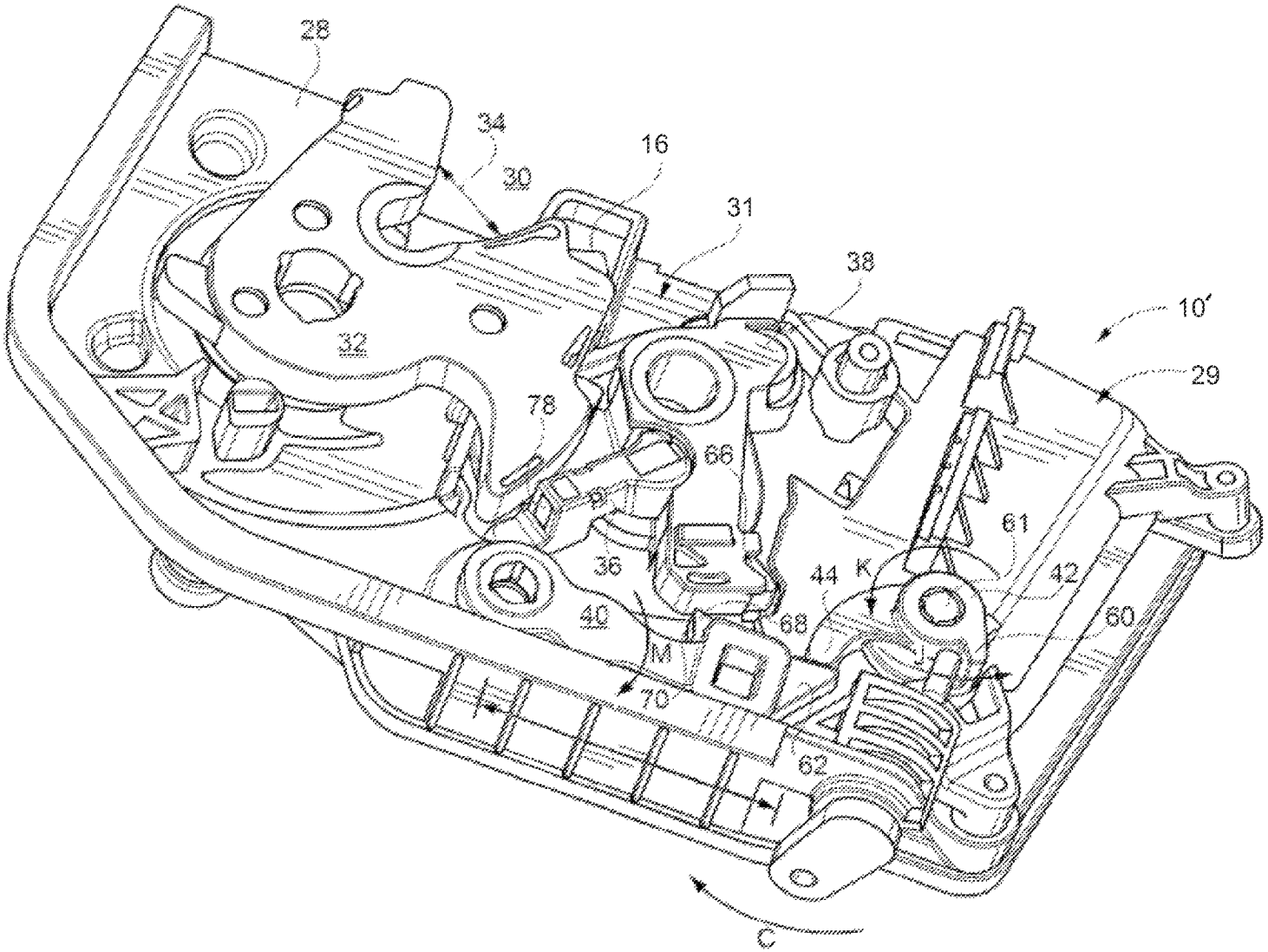
FIG. 4 is an isometric view, similar to FIG. 3, but now showing the closure latch assembly in an Open mode.

Outside backup release mechanism 35 includes a release lever 42 which is pivotably moveable between a first or "standby" position (FIG. 3) whereat its actuator lug 44 is located adjacent to secondary pawl 40 while secondary pawl 40 is located in its closed position, and a second or "active" position (FIG. 4) whereat release lever 42 moves and holds secondary pawl 40 in its open position. Release lever 42 is coupled (directly or indirectly) to key lever 46 for transmitting rotation of key cylinder 50 into pivotal movement of release lever 42 so as to move release lever 42 from its standby position to its active position. Key lever 46 is moveable between its non-actuated position (FIG. 3) and its actuated position (FIG. 4) for moving release lever 42 between its standby position and its active position. Insertion of key 27 into key cylinder 50 facilitates and permits manual rotation of key cylinder 50 in the releasing direction for manually releasing latch mechanism 31. Key lever 46 is shown to include a finger 58 positioned for engagement with a lug 60 on release lever 42. As seen in FIG. 4, rotation of key lever 46 in the direction indicated by arrow "C" causes finger 58 to push against lug 60 in the direction of arrow "J", thereby causing release lever 42 to pivot about a release lever axis 61 in the direction of arrow "K". Thus, if power release motor 41 is inoperable, key 27 can be used in conjunction with outside backup release mechanism 35 to manually release latch mechanism 31.

With continued reference to FIGS. 3 and 4, a locking toe segment 66 of secondary ratchet 38 is adapted to engage a stop notch 68 formed on secondary pawl 40 when latch mechanism 31 is latched. Likewise, an end segment 74 of primary pawl 36 is adapted to engage a primary lock tooth 76 formed on primary ratchet 32 when latch mechanism 31 is latched. However, because primary pawl 36 is supported by secondary ratchet 38, pivotal movement of secondary ratchet 38 from its engaged position to its disengaged position causes end segment 74 of primary pawl 36 to be pulled out of engagement with primary lock tooth 76 so as to permit primary pawl 36 to pivot from its closed position to its open position, thereby releasing primary ratchet 32 for rotation to its striker release position.

Referring now to FIGS. 5-13, the components associated with an alternative embodiment of a closure latch assembly 100, constructed in accordance with a preferred embodiment of the present disclosure, are shown to include, amongst other things, a latch mechanism 102, a latch release mechanism 104, and an outside backup release mechanism 106. In general, closure latch assembly 100 is adapted for use with a closure member, such as a door, of a motor vehicle. More specifically, closure latch assembly 100 is configured to permit manual actuation of a door-mounted and/or handle-mounted key cylinder via a key to facilitate a manually-operated outside release of latch mechanism 102 in response to actuation of outside backup release mechanism 106. However, latch mechanism 102 and outside backup release mechanism 106 can only be subsequently reset via actuation of a manually-operated reset lock device 108. These and other features of closure latch assembly 100 will become more clearly understood based on the following detailed description.

Figure 5:
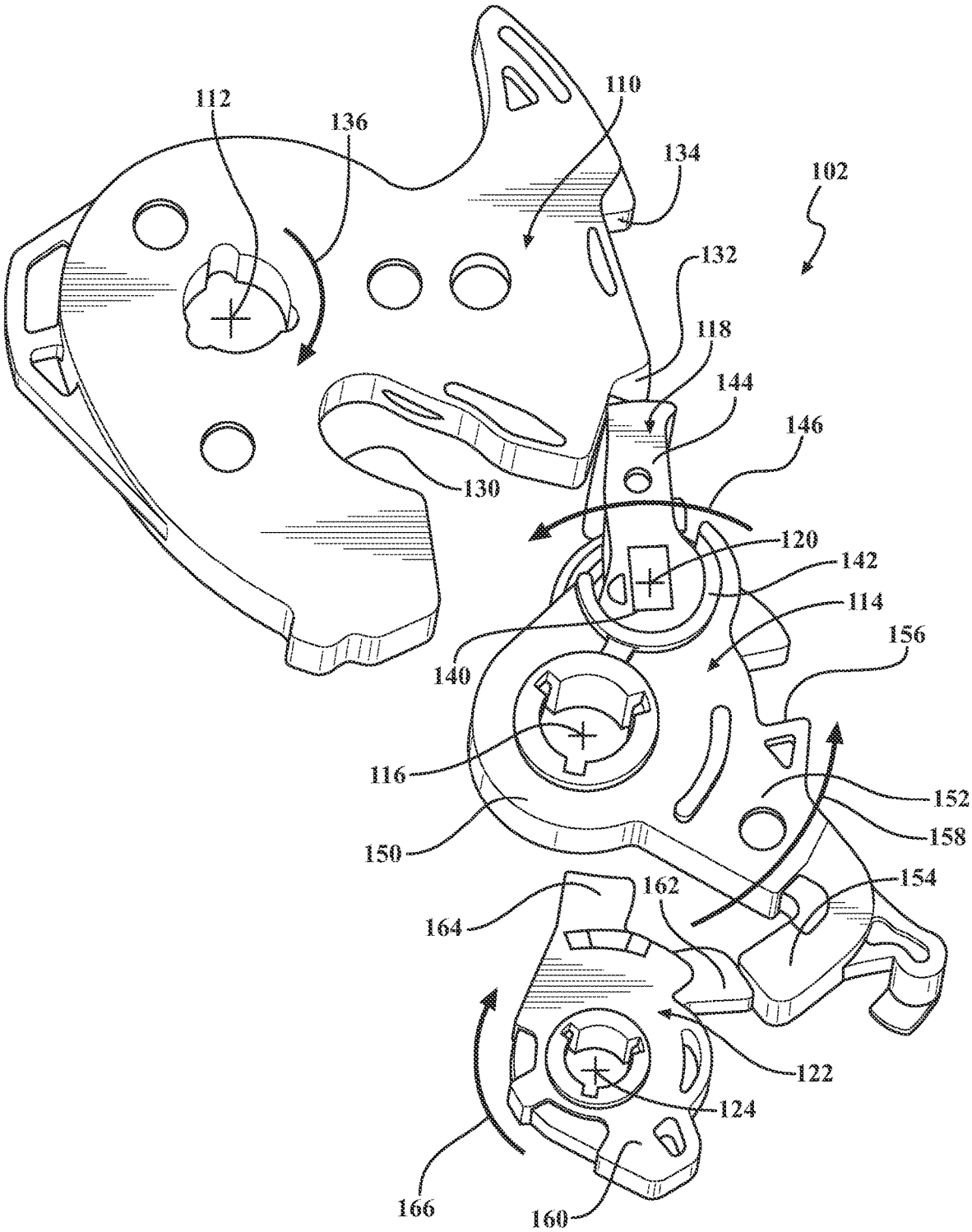
FIG. 5 is an isometric view of a latch mechanism associated with an alternative embodiment of a closure latch assembly constructed in accordance with the present disclosure.

Referring initially to FIG. 5, latch mechanism 102 is shown in this non-limiting embodiment configured as a double pawl-double ratchet arrangement having a primary ratchet 110 rotatable about a primary ratchet axis 112, a secondary ratchet 114 rotatable about a secondary ratchet axis 116, a primary pawl 118 supported on secondary ratchet 114 for pivotal movement about a primary pawl axis 120, and a secondary pawl 122 rotatable about a secondary pawl axis 124. Again, latch mechanism 102 is represented as a double ratchet-double pawl arrangement; however, as noted above, the disclosure is intended to represent any suitable configuration operable in a latched/closed state for retaining a striker and an unlatched/open state for releasing the striker, including a single ratchet-single pawl arrangement.

Primary ratchet 110 is configured to include a striker capture slot 130, a primary closing notch 132, and a secondary closing notch 134. Primary ratchet 110 is moveable between a first or "primary close" position (FIG. 8A) and a second or "open" position (FIG. 10A). A primary ratchet spring (not shown) is operable to bias primary ratchet 110 toward its open position, as indicated by arrow 136.

Primary pawl 118 has a cylindrical pivot section 140 pivotably retained in a cylindrical boss section 142 of secondary ratchet 114, and a lock section 144 selectively engageable with one of primary closing notch 132 and secondary closing notch 134 on primary ratchet 110. Primary pawl 118 is pivotably moveable between a first or "closed" position (FIG. 8A) and a second or "open" position (FIG. 18A). In its closed position, lock section 144 engages primary closing notch 132 to hold primary ratchet 110 in its primary close position or lock section 144 can engage second closing notch 134 to hold primary ratchet 110 in a third or "secondary close" position. With primary pawl 118 located in its open position, its lock section 144 is displaced from engagement with either of closing notches 132, 134 to allow ratchet 110 to rotate to its open position. A primary pawl spring (not shown) is operable for normally biasing primary pawl 118 toward its closed position, as indicated by arrow 146.

Secondary ratchet 114 is shown to include a pivot section 150 on which boss section 142 is formed, and an elongated leg section 152 terminating in a drive lug 154. Secondary ratchet 114 is moveable between a first or "engaged" position (FIG. 8A) and a second or "disengaged" position (FIG. 10A). A secondary ratchet biasing member (not shown) is provided for normally biasing secondary ratchet 114 toward its engaged position, as indicated by arrow 158. With secondary ratchet 114 located in its engaged position, primary pawl 118 is held in its closed position. In contrast, movement of secondary ratchet 114 to its disengaged position causes corresponding movement of primary pawl 118 to its open position.

Secondary pawl 122 is shown to include a pivot segment 160, a lock lug segment 162, and an engagement segment 164. Secondary pawl 122 is moveable between a first or "closed" position (FIG. 8A) and a second or "open" position (FIG. 10A). A secondary pawl biasing member (not shown) is provided for normally biasing secondary pawl 122 toward its closed position, as indicated by arrow 166. With secondary pawl 122 located in its closed position, lock lug segment 162 engages drive lug 154 on secondary ratchet 114 and holds secondary ratchet 114 in its engaged position. In contrast, movement of secondary pawl 122 to its open position functions to release its lock lug segment 162 from engagement with drive lug 154 on secondary ratchet 114, thereby permitting secondary ratchet 114 to move to its disengaged position.

Figure 6:
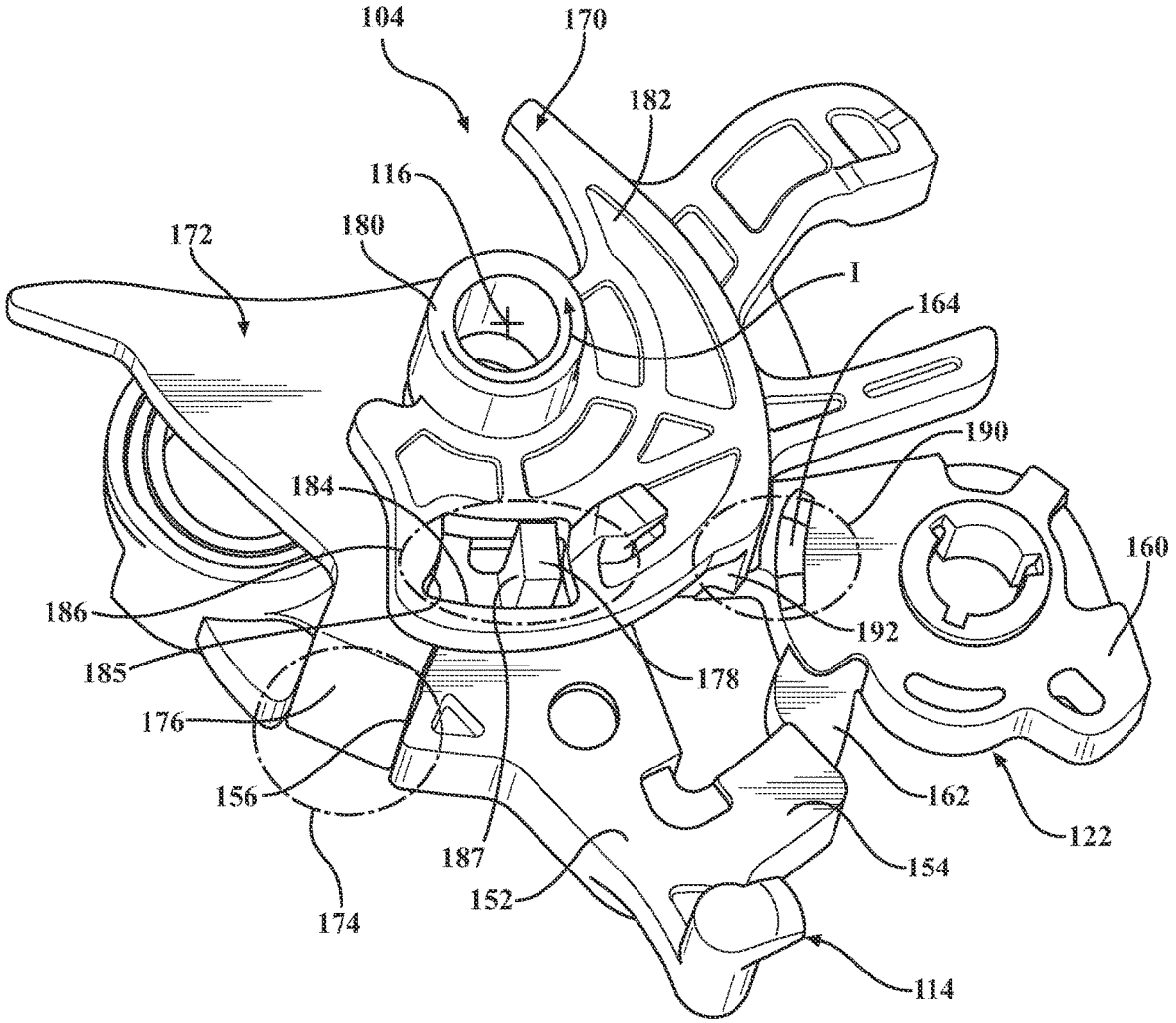
FIG. 6 is a built-up isometric view of the latch mechanism shown in FIG. 5 now including a latch release mechanism also associated with the alternative embodiment of the closure latch assembly of the present disclosure.
Figure 12B:
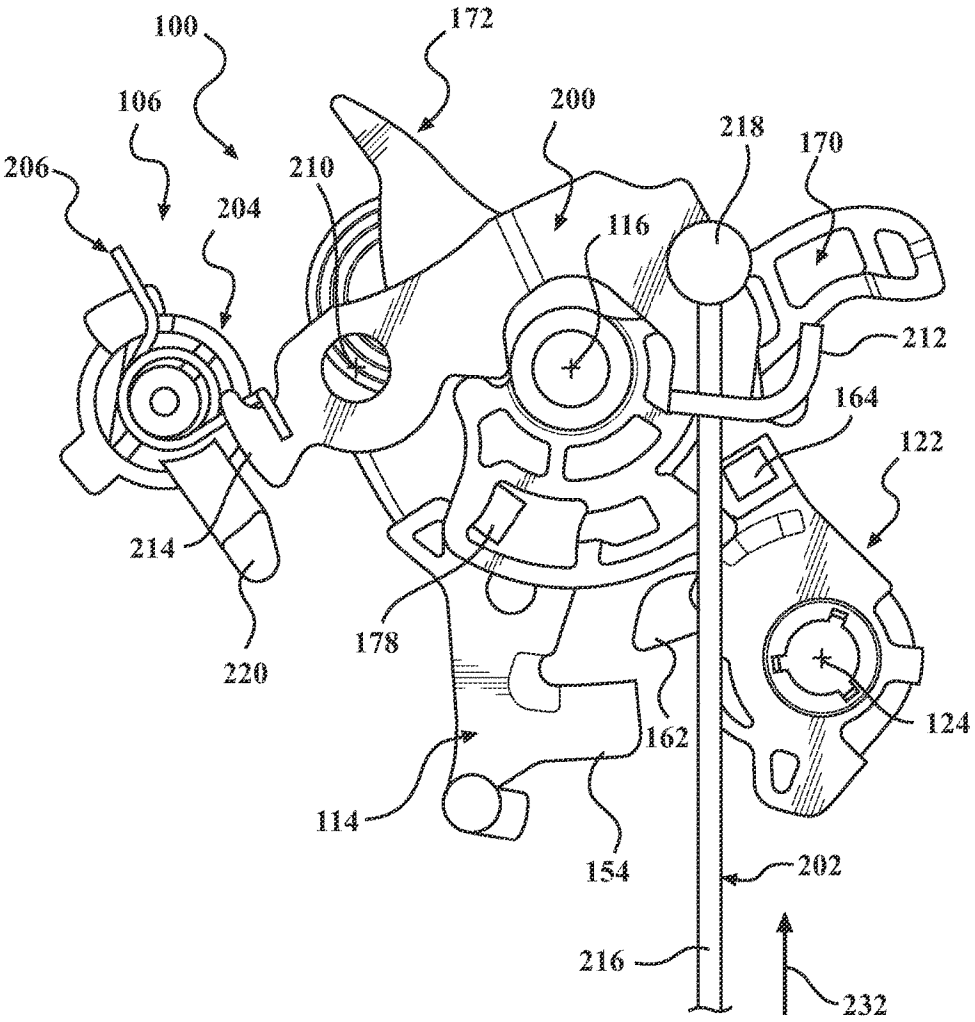
FIGS. 12A and 12B are plan views similar to FIGS. 11A and 11B, respectively, but which now illustrate movement of the components in response to initiation of a manual latch reset action, using a key-type actuator as indicated by FIG. 12C.
Figure 12A:
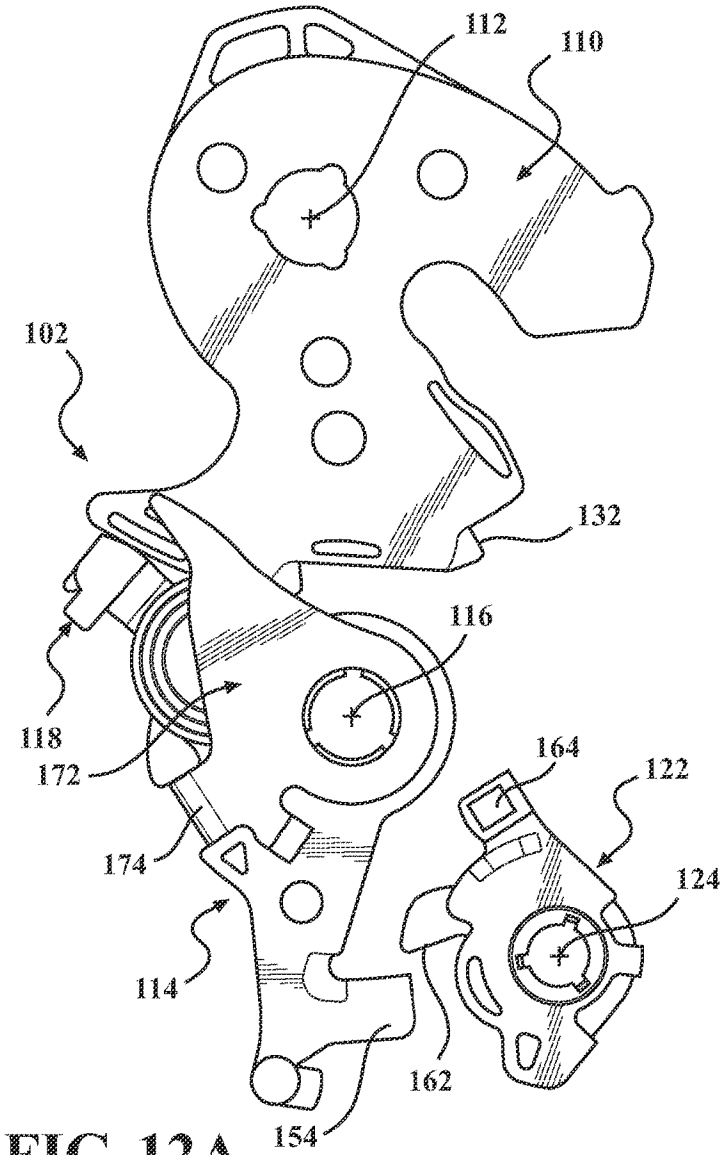

Referring now to FIG. 6, the components of latch release mechanism 104 are shown in association with the components of latch mechanism 102 (FIG. 5) and generally include a release lever 170 and a primary pawl lever 172. Primary pawl lever 172 is disposed between secondary ratchet 114 and release lever 170, with both release lever 170 and primary pawl lever 172 being aligned with secondary ratchet axis 116 for pivotal movement relative thereto. As indicated by circle 174, primary pawl lever 172 has a drive tab 176 disposed within a retention notch 156 formed in leg segment 152 of secondary ratchet 114 such that primary pawl lever 172 moves between a first or "rest" position (FIG. 8A) and a second or "closed" position (FIG. 12B) in response to movement of secondary ratchet 114 between its engaged and disengaged positions. Release lever 170 includes a boss segment 180 aligned with axis 116 and a body segment 182 having a guide slot 184 within which a guide lug 178 formed on primary pawl lever 172 is retained, as indicated by circle 186, to establish a uni-directional drive connection therebetween upon rotation of release lever 170 in a counterclockwise direction represented by arrow I by resulting in a contact of end wall 185 of guide slot 184 abutting lug surface 187 of guide lug 178 after a predetermined rotation of the release lever 170 to thereby engage and urge the primary pawl lever 172 in corotation with the release lever 170 after abutment during continued rotation I of the release lever 170 (see FIG. 10B). Release lever 170 is moveable about axis 116 between a first or "rest" position (FIGS. 8A, 8B) and a second or "engaged" position (FIGS. 12A, 12B). A release lever biasing member (not shown) is provided for normally biasing release lever 170 toward its rest position. Circle 190 identifies that a uni-directional drive connection is established between engagement lug segment 164 on secondary pawl 122 and a cam segment 192 formed on release lever 170 upon rotation of release lever 170 in a counterclockwise direction represented by arrow I by resulting in a contact of cam segment 192 abutting lug segment 164 after a predetermined rotation of the release lever 170 to thereby engage and urge (e.g. rotate) the secondary pawl 122 from its closed position to its open position (see FIG. 9B). Illustratively, contact of cam segment 192 abutting lug segment 164 occurs before, such as slightly before as an example, the contact of the contact of end wall 185 of guide slot 184 abutting lug surface 187 of guide lug 178, such that continued corotation of release lever 170 and primary pawl lever 172 is not prevented e.g. blocked by the action of lock lug segment 162 of secondary pawl 122 in its closed position in engagement with drive lug 154 on secondary ratchet 114, thereby allowing drive lug 154, as urged by the forces transferred from the ratchet 110 to the secondary ratchet 114, to move in a direction indicated by arrow K in FIG. 9B to bypass lug segment 162.

Figure 7:
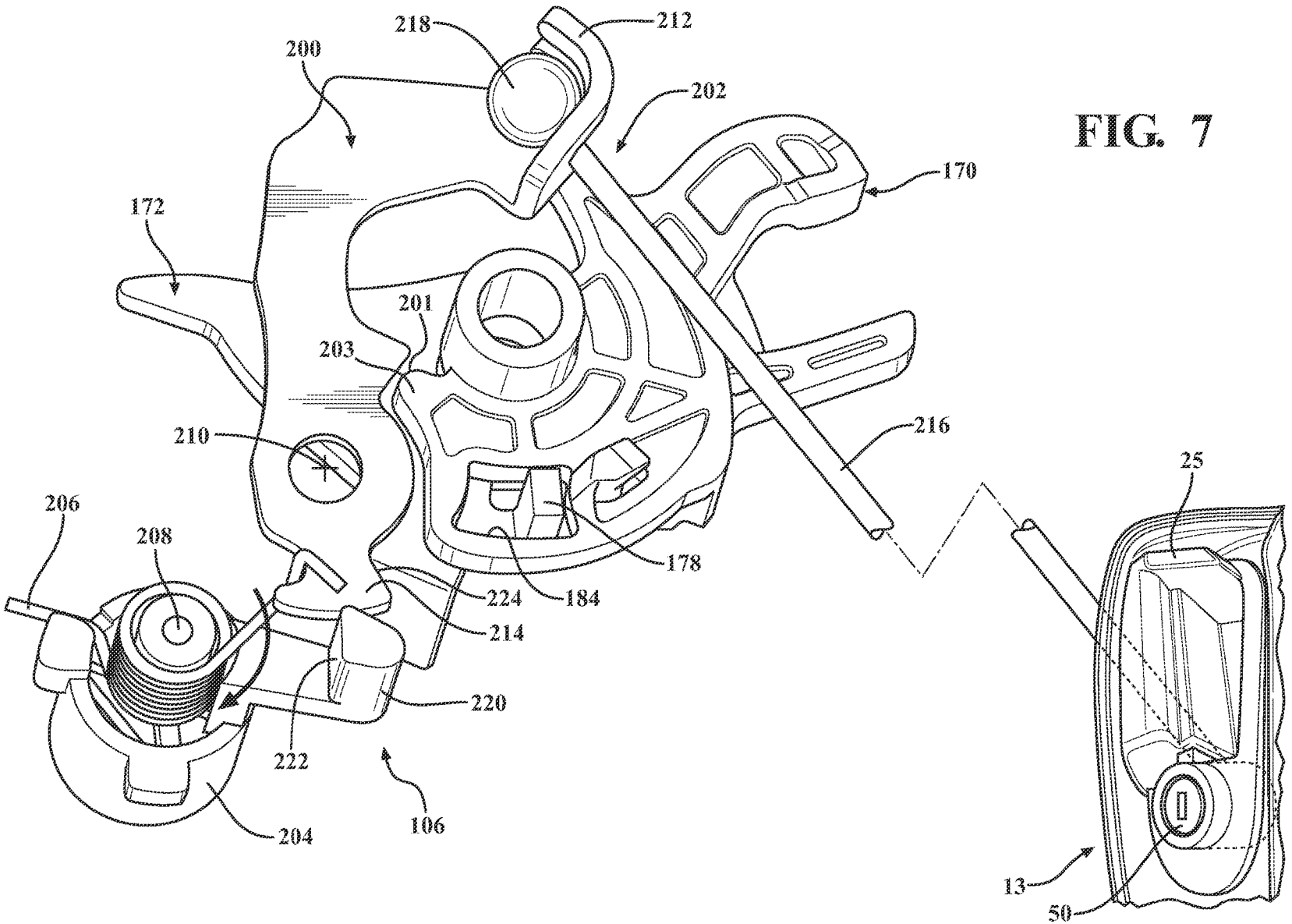
FIG. 7 is a further built-up isometric view of the latch release mechanism shown in FIG. 6 now including an outside backup release mechanism having a manual reset function and embodied in the alternative embodiment of the closure latch assembly of the present disclosure.
Figure 7A:
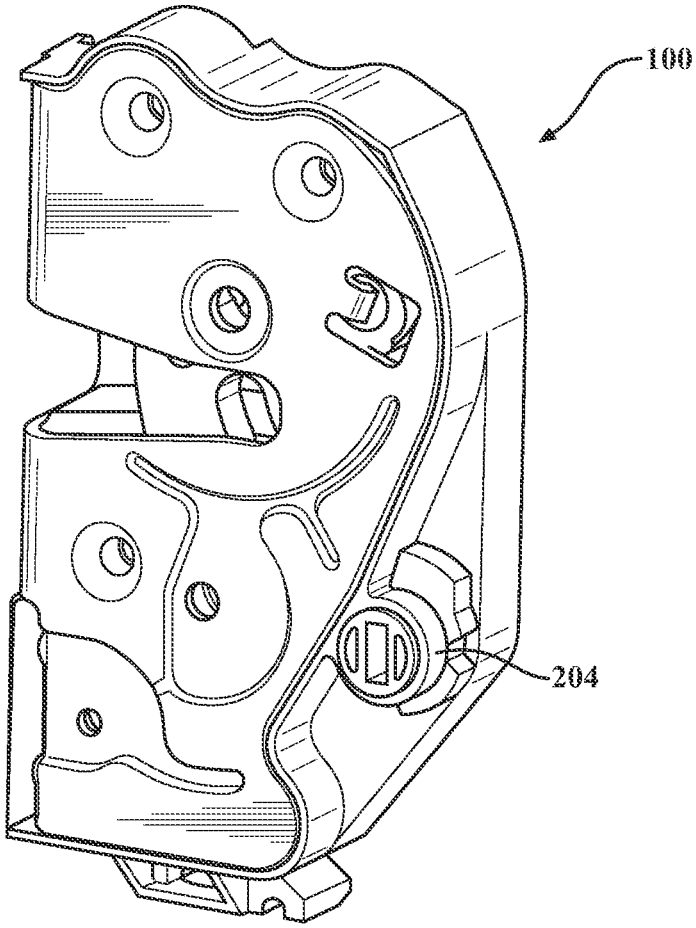
FIG. 7A is an isometric view of the closure latch assembly showing a reset device associated with the outside backup release mechanism.
Figure 7B:
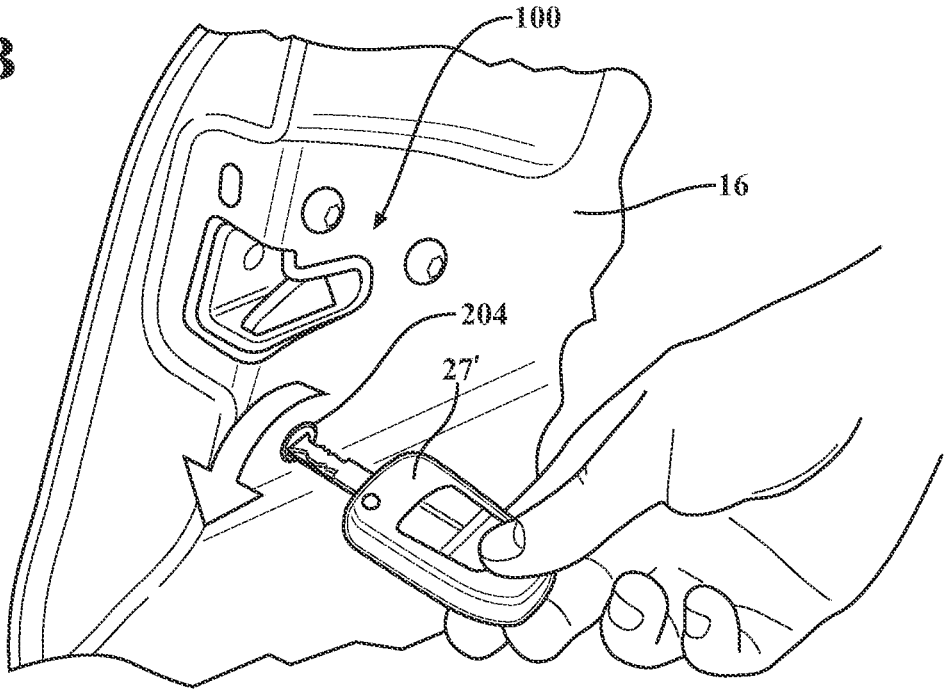
FIG. 7B is an illustration showing a manual latch resetting operation of the reset device.
Figure 8B:
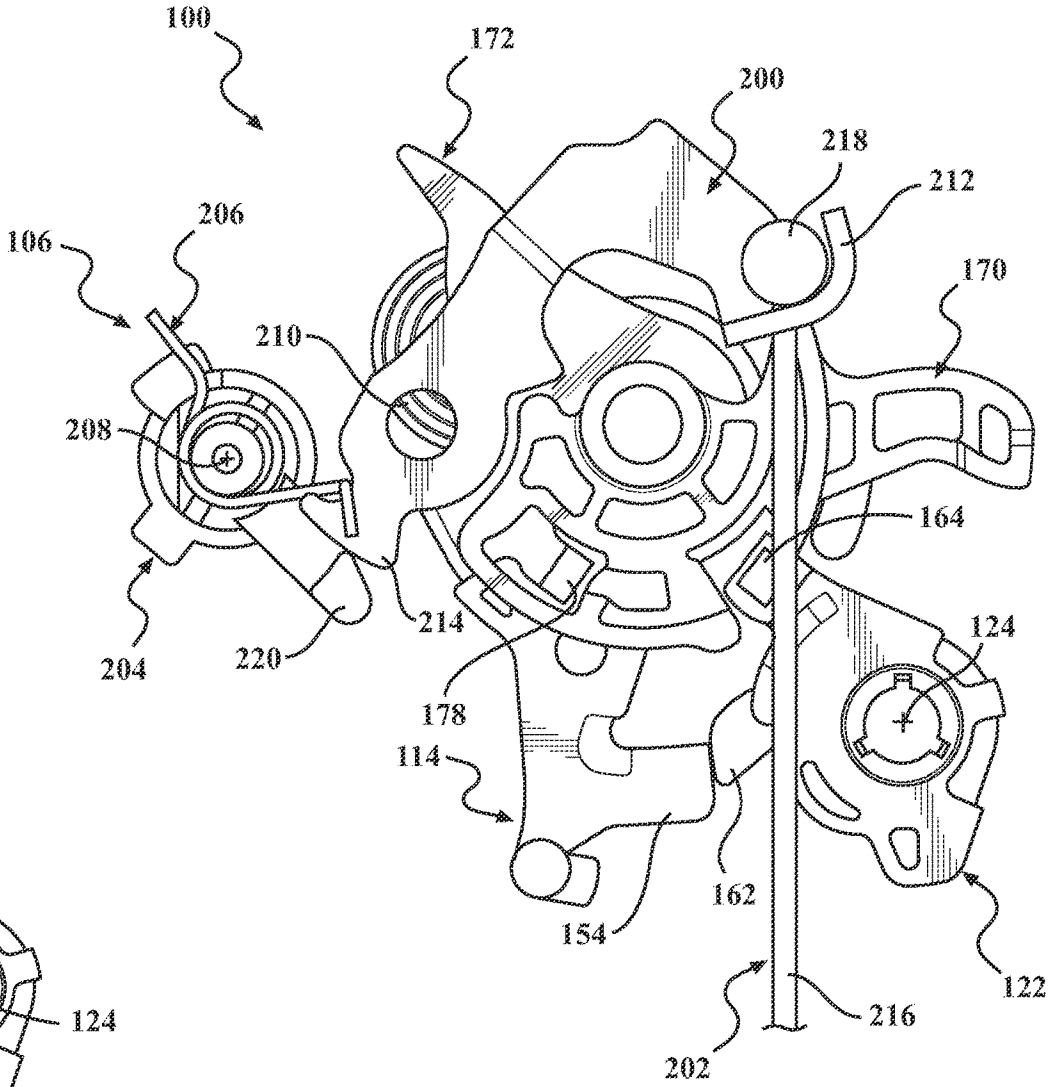
FIG. 8A is a plan view of the latch mechanism in a Primary Closed state and FIG. 8B is a plan view of the outside backup release mechanism in a Rest state to establish a Latched mode for the closure latch assembly of the present disclosure.
Figure 8A:
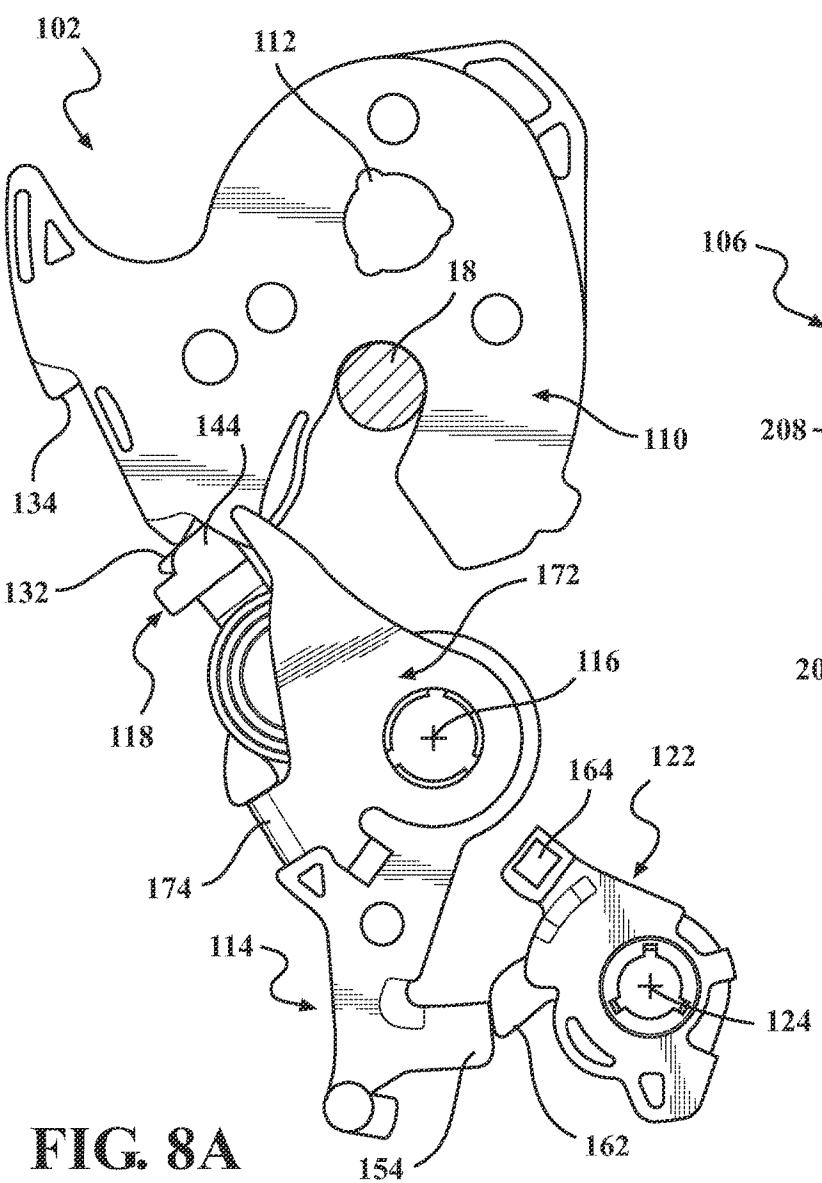

Referring now to FIG. 7, the components of outside (OS) backup release mechanism 106 are shown in association with the components of latch release mechanism 104 (FIG. 6) and generally include an OS backup lever 200, an OS connection device 202, an OS reset knob 204, and a reset knob biasing member, also referred to as reset knob spring 206. FIG. 7A illustrates the orientation of OS reset knob 204 with respect to closure latch assembly 100 while FIG. 7B illustrates an intentional manual reset actuation operation of OS reset knob 204 by a user (see hand) via a key 27'. OS backup lever 200 is supported for pivotal movement about an OS backup lever pivot axis 210 between a first or "rest" position (FIG. 8B) and a second or "engaged" position (FIG. 11B) and includes a connector flange 212 and a spring flange 214. OS backup connection device 202 is shown, in this non-limiting example, to include a bowden cable 216 having a ferrule 218 at a first cable end acting against connector flange 212 and a second cable end connected to link 52 (FIG. 1B) of key cylinder 50, thereby mechanically connecting exterior door handle 25 to closure latch assembly 100.

Figure 11B:
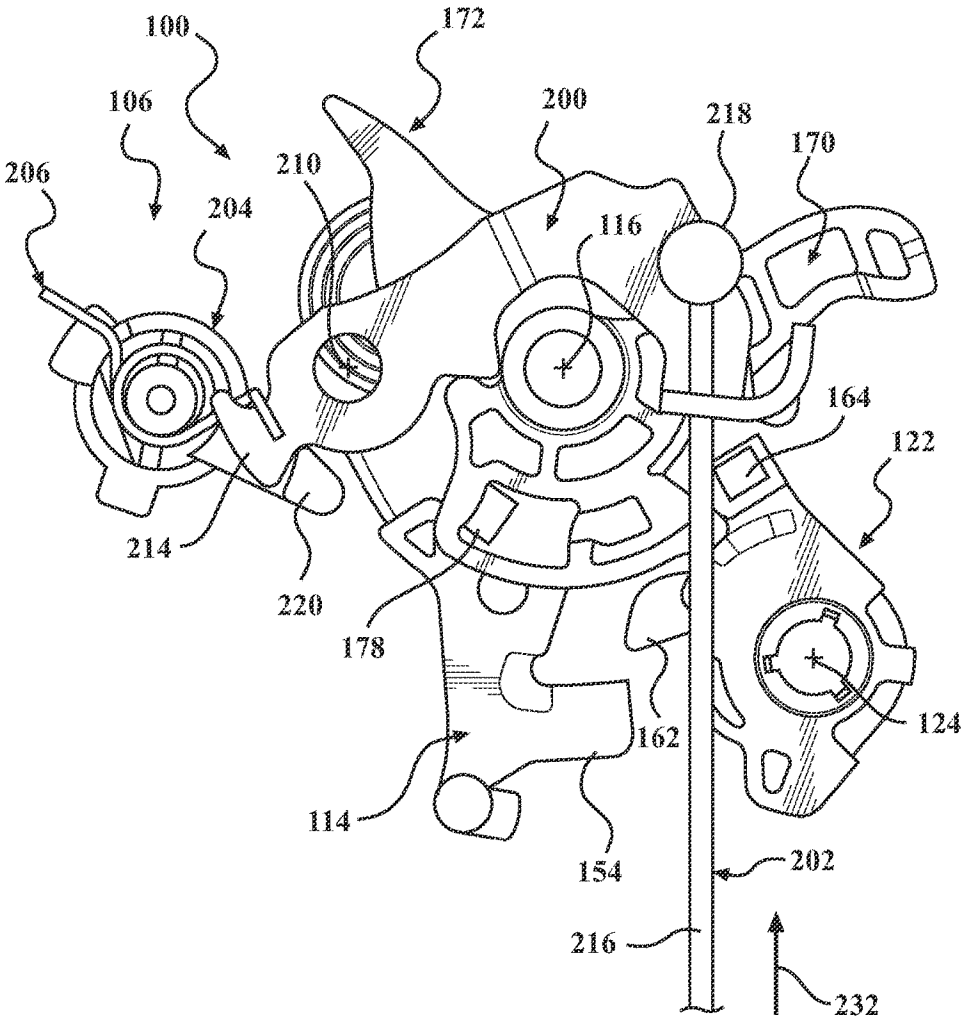
FIGS. 11A and 11B are plan views similar to FIGS. 10A and 10B, respectively, but which illustrate completion of the manual outside latch release action with the latch mechanism in an Open state and the outside backup release mechanism in an Engaged state to establish an Unlatched-Blocked mode for the closure latch assembly of the present disclosure.

OS reset knob 204 is supported in latch housing 29 for movement about a reset knob pivot axis 208 between a first or "unlock" position (FIG. 8B) and a second or "lock" position (FIG. 11B). Reset knob spring 206 is configured to normally bias OS reset knob 204 towards its lock position. As seen, reset knob spring 206 also engages and acts upon spring flange 214 on OS backup lever 200 so as to bias OS backup lever 200 towards its rest position. OS reset knob 204 includes a blocking lug segment 220 having a cam edge 222 configured to engage a blocking edge 224 on spring flange 214 when OS backup lever 200 is located in its engaged position and while OS reset knob 204 is in its lock position. As will be described, a manual latch release operation is provided by a user inserting and rotating key 27' within key cylinder 50 for causing connection device 202 to move OS backup lever 200 from its rest position to its engaged position which, in turn, results in release of latch mechanism 102. Additionally, a manual latch reset operation is provided by the user inserting and rotating key 27' within OS reset knob 204 for subsequently resetting OS backup release mechanism 106.

Referring now to FIGS. 8-11, a sequential series of views are shown associated with a manual latch release operation initiated by a first "manual release" action provided by the user inserting and rotating key 27' within door-mounted key cylinder 50 to unlatch closure latch assembly and allow door 13 to move from its closed position to its open position. FIGS. 8A and 8B illustrate the components of closure latch assembly 100 oriented and positioned to define a Latched mode wherein: primary ratchet 110 is located in its primary closed position; primary pawl 118 is located in its closed position; secondary ratchet 114 is located in its engaged position; secondary pawl 122 is located in its closed position; primary pawl lever 172 is located in its rest position; release lever 170 is located in its rest position; OS backup lever 200 is located in its rest position; and OS reset knob 204 is located in its unlock position. Thus, double pawl-double ratchet latch mechanism 102 is in a Primary Closed state and OS backup release mechanism 106 is in a Rest state.

Figures 9A, 9B:
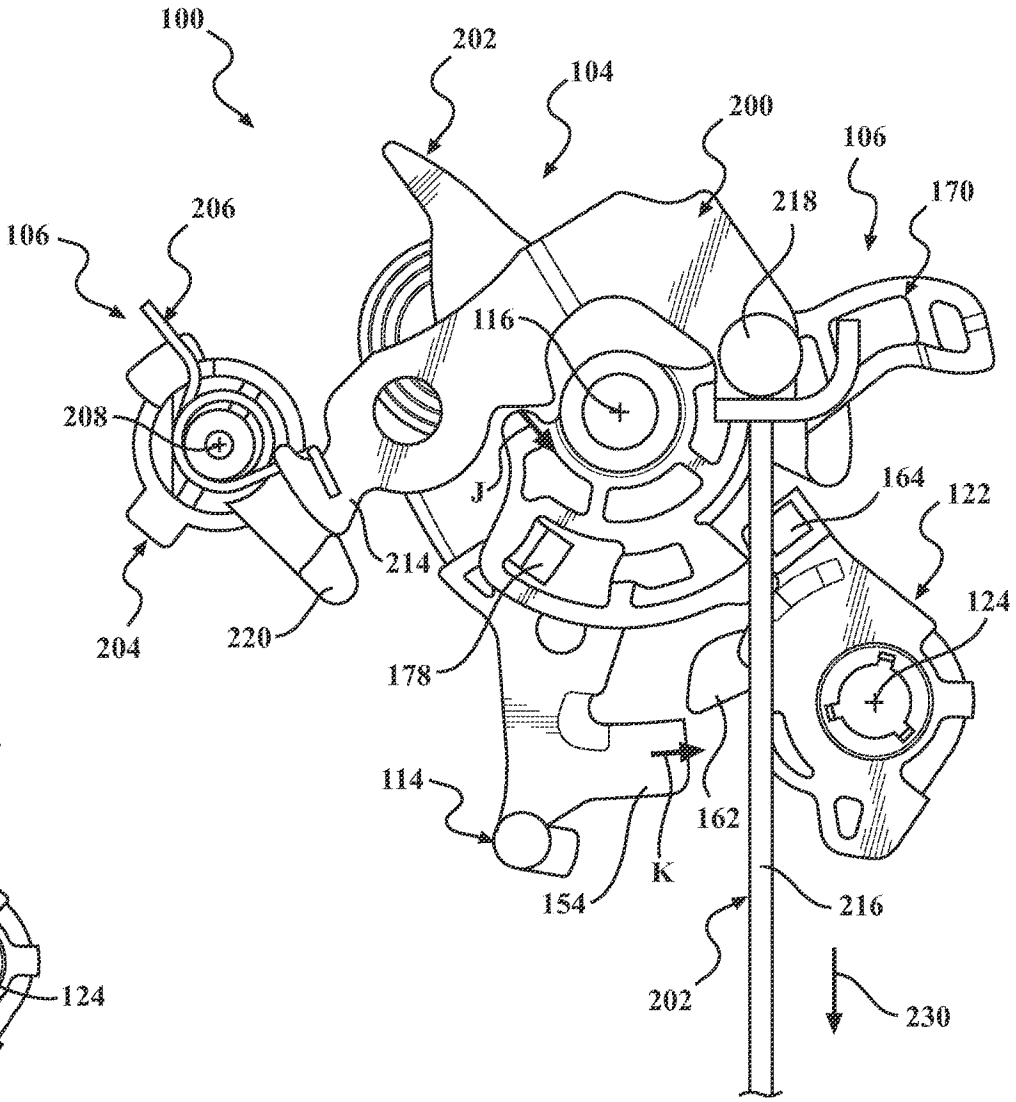
FIGS. 9A and 9B are plan view similar to FIGS. 8A and 8B, respectively, but illustrating movement of the components in response to initiation of a manual outside latch release action.

Referring now to FIGS. 9A and 9B, movement of the components is shown in response to initiation of the manual outside release operation resulting from the user inserting key 27' into key cylinder 50, such as on outside door handle 25, by way of example and without limitation, and rotating key cylinder 50 to cause cable 216 to translate in the direction indication by arrow 230. This action causes OS backup lever 200 to rotate from its rest position in a releasing direction (clockwise direction as shown in FIG. 9B) toward its engaged position. Such rotation of OS backup lever 200 causes corresponding movement of release lever 170 in a releasing direction from its rest position toward its disengaged position which (e.g. through engagement of backup lever abutment surface 201 with release lever lug 203 for providing rotation of the backup lever 200 with the release lever 170 during engagement as indicated by arrow J in FIG. 9B), in turn, causes secondary pawl 122 to rotate from its closed position into its open position for releasing lock lug segment 162 from engagement with drive lug 154 on secondary ratchet 114. As seen, lock section 144 of primary pawl 118 remains engaged with primary close notch 132 on primary ratchet 110, thereby continuing to hold primary ratchet 110 in its primary closed position. In addition, such rotating of OS backup lever 200 causes an outer surface of spring flange segment 214 to slide along cam segment 220 of OS reset knob 204, in opposition to the biasing extended thereon by spring 206.

Figure 10B:
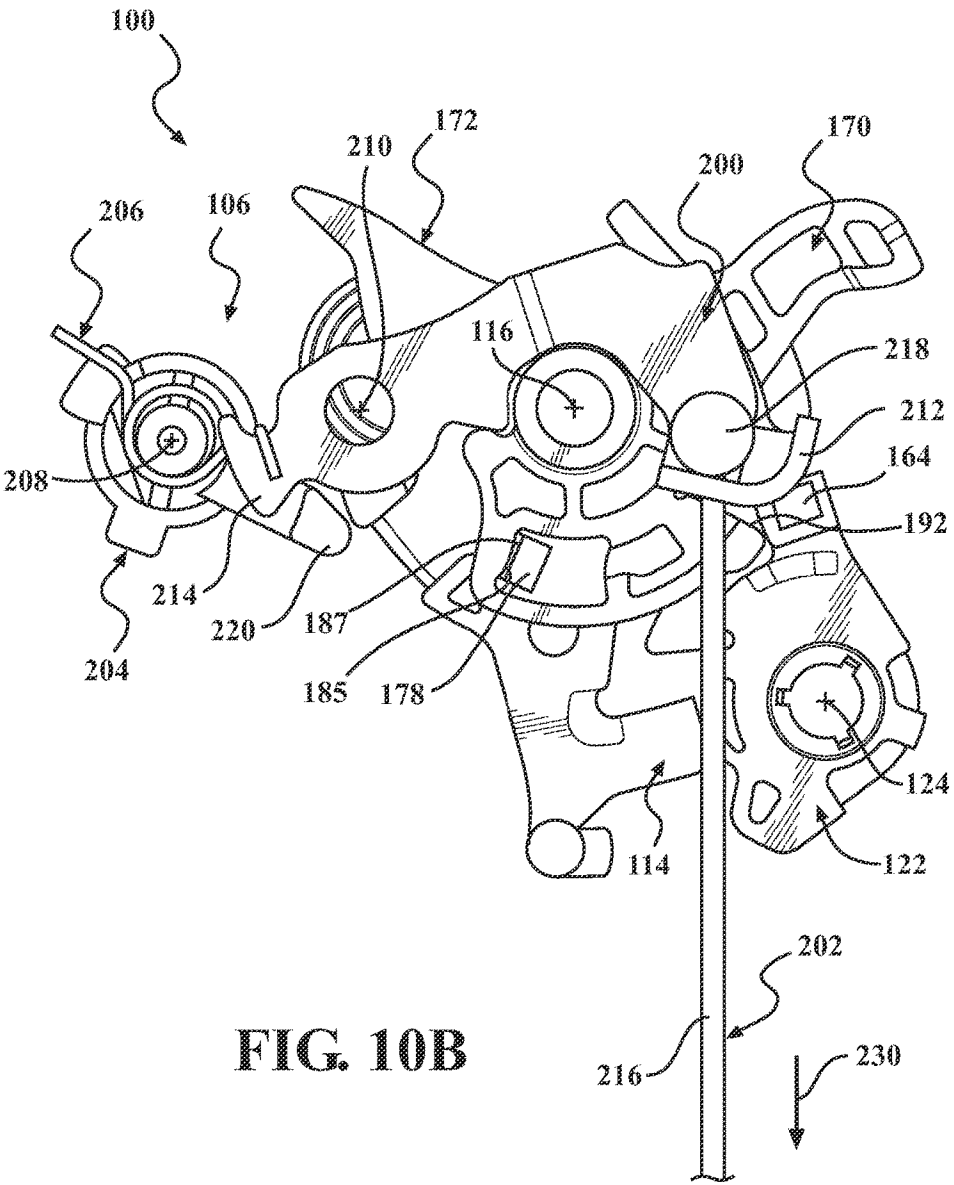
FIGS. 10A and 10B are plan views similar to FIGS. 9A and 9B, respectively, but illustrating further movement of the components in response to continuation of the manual outside latch release action.
Figure 10A:
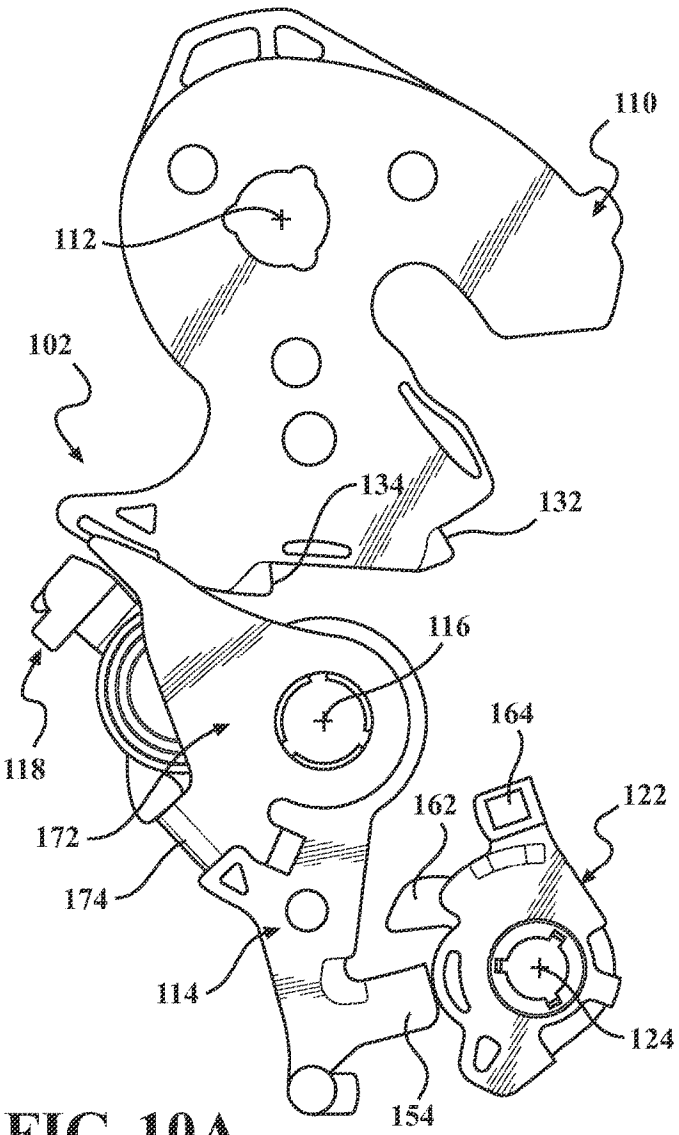

Referring now to FIGS. 10A and 10B, continued movement of the components is shown in response to an "end of travel" portion of the key-actuated manual outside release operation. As seen, OS backup lever 200 has moved release lever 170 so as to establish an Open state for latch mechanism 102 such that primary pawl 118 has moved into its open position disengaged from primary close notch 132 on primary ratchet 110, thereby permitting the primary ratchet biasing member to drive primary ratchet 110 to its open position. As seen, OS reset knob spring 206 has caused blocking lug segment 220 on OS reset knob 204 to move into engagement with spring flange 214 on OS backup lever 200, thereby mechanically holding and releasably maintaining OS backup lever 200 in its engaged position. This action results in OS reset knob 204 moving from its unlock position into its lock position.

Figure 11A:
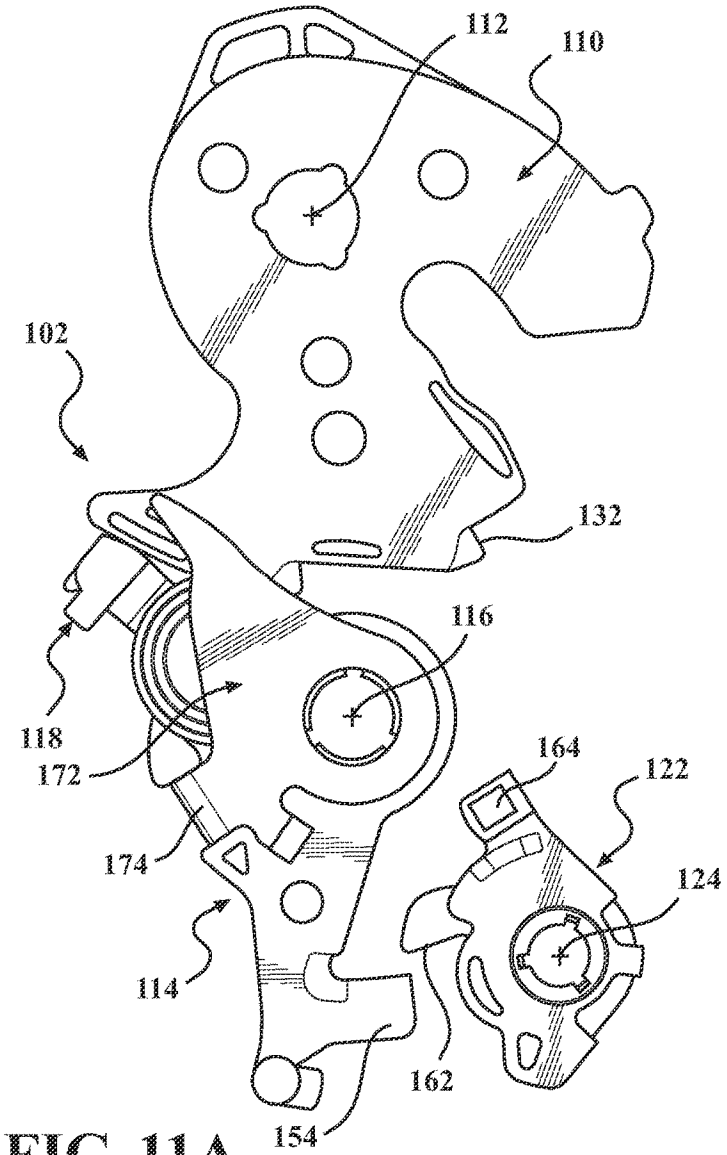

Referring now to FIGS. 11A and 11B, key 27' has been rotated in the opposite direction within key cylinder 50 to allow removal of key 27' from cylinder 50. The corresponding movement of connection device 202 is shown by arrow 232. However, OS reset knob 204 is held in its lock position with OS backup lever 200 held in its engaged position. Likewise, release lever 170 is prevented from returning to its rest position and, as such, continues to hold secondary pawl 122 in its open position so as to permit secondary ratchet 114 to stay in its disengaged position. Accordingly, OS backup release mechanism 106 is operating in an Engaged state with latch mechanism 102 operating in its Open state, so as together establish an Unlatched-Blocked mode for closure latch assembly 100. In this mode, any attempt to close door 13 will result in no latching of closure latch assembly 100 and door 13 will rebound.

Figure 12C:
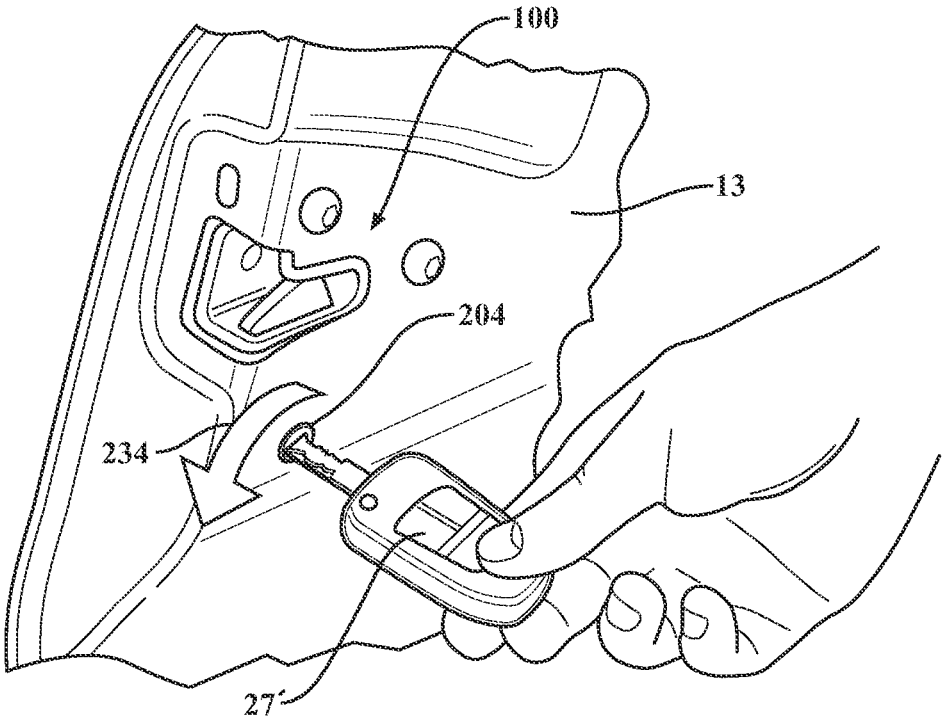
Figure 13B:
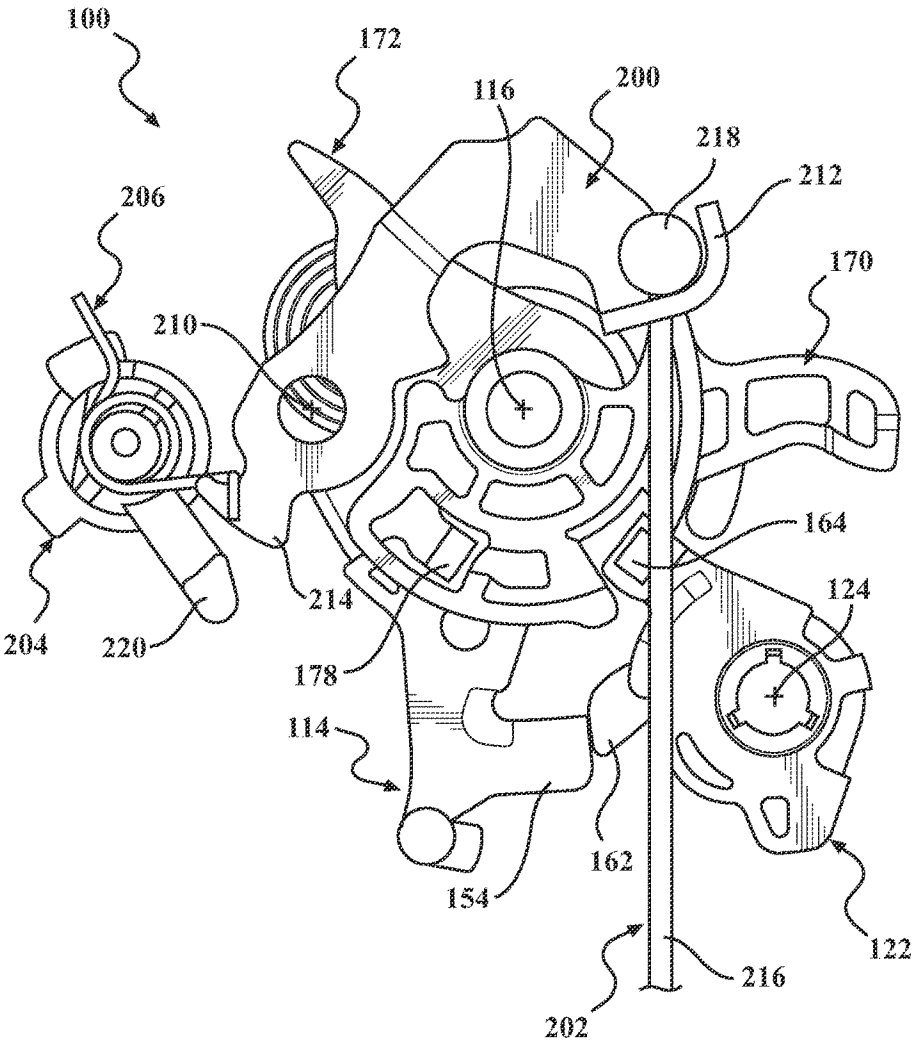
FIGS. 13A and 13B are plan views similar to FIGS. 12A and 12B, respectively, now showing the latch mechanism in a Reset state with the outside backup release mechanism returned to its Rest state so as to establish an Unlatched-Reset mode for the closure latch assembly of the present disclosure.
Figure 13A:
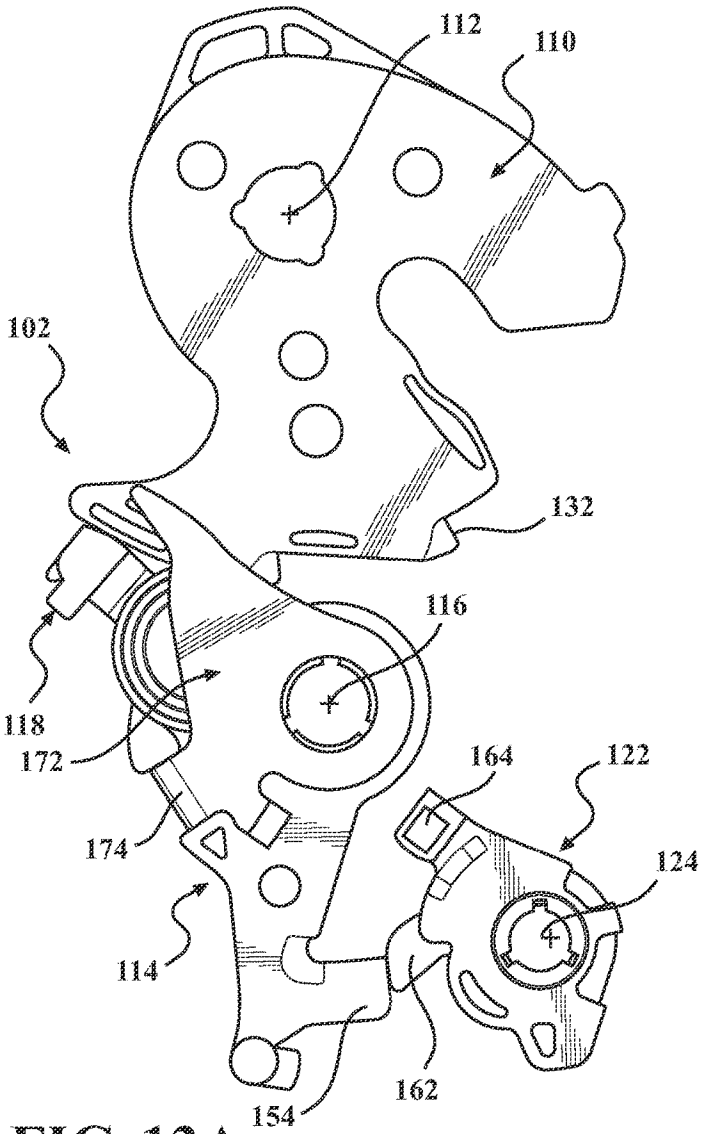

Referring now to FIGS. 12A-12B and 13A-13B, a sequential series of views are provided to illustrate a "manual resetting" action provided for resetting closure latch assembly 100 from its Unlatched-Blocked mode (FIGS. 11A and 11B) into an Unlatched-Reset mode in preparation for a subsequent closing of door 13 and latching of closure latch assembly 100. FIG. 12C illustrates a user inserting key 27' into OS reset knob 204 and manually rotating OS reset knob 204 from its lock position (FIG. 11B) into its unlock position (FIG. 13B), as indicated by arrow 234. Such manual rotation of OS reset knob 204 permits OS backup lever 200 to disengage blocking lug segment 220 and rotate from its engaged position (FIG. 11B) back to its rest position (FIG. 13B) in response to the biasing exerted thereon by the OS lever biasing member. Such rotation of OS backup lever 202 back to its rest position acts to also permit release lever 170 to return to its rest position and to permit secondary pawl 122 to return to its closed position. As such, secondary ratchet 114 is now engaged with secondary pawl 122, whereby primary ratchet 110 can be engaged and latched by primary pawl 118 upon a subsequent closing of door 13.

Thus, the present disclosure provides a closure latch assembly having a reset device configured to be manually actuated after an external latch releasing operation to reset a latch mechanism for a subsequent door closing operation. The OS knob lever has a key-shaped interface, similar to mechanical child lock devices, that is configured to accept a key and be rotated so as to reset the latch mechanism to permit closure and latching of the vehicle door. This arrangement provides a mechanical "blocking" of the release lever that can only be intentionally overcome via an intentional latch reset operation.

The foregoing description of the embodiments has been provided for purposes of illustration and description. It is not intended to be exhaustive or to limit the disclosure. Individual elements, assemblies and/or subassemblies, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A closure latch assembly for installation in a vehicle door having an outside handle, comprising:

a latch mechanism having a primary ratchet and a primary pawl, the primary ratchet being moveable between a striker capture position whereat the primary ratchet retains a striker and a striker release position whereat the primary ratchet releases the striker, the primary pawl being moveable between a closed position whereat the primary pawl holds the primary ratchet in its striker capture position and an open position whereat the primary pawl is positioned to permit the primary ratchet to move to its striker release position;

a latch release mechanism having a release lever being moveable between a rest position whereat the primary pawl is located in its closed position and an engaged position whereat the release lever moves the primary pawl to its open position; and an outside backup release mechanism having an OS backup lever, and OS connection device connecting the OS backup lever to a key cylinder associated with the outside handle and an OS reset knob, the OS backup lever being moveable between a rest position and an engaged position causing corresponding movement of the release lever between the rest position and the engaged position, the OS reset knob being moveable between an unlock position permitting the OS backup lever to move to its rest position and a lock position whereat the OS reset knob holds the OS backup lever in its engaged position, wherein a manual latch release operation includes manually actuating the key cylinder to move the OS connection device and causing the OS backup lever to move from its rest position to its engaged position for moving the release lever to its engaged position so as to shift the closure latch assembly from a Latched mode into an Unlatched-Blocked mode with the OS reset knob in its lock position for blocking movement of the OS backup lever from its engaged position to its rest position and holding the release lever in its engaged position, wherein a manual latch reset operation includes shifting the closure latch assembly from its Unlatched-Blocked mode into an Unlatched-Reset mode, the manual latch reset operation includes manually moving the OS reset knob from its lock position to its unlock position for permitting the OS backup lever to return to its rest position and for permitting the release lever to return to its rest position.

2. The closure latch assembly of claim 1, wherein the key cylinder is configured for the insertion and rotation of a key therein for causing the connection device to move the OS backup lever from its rest position to its engaged position.

3. The closure latch assembly of claim 2, wherein the OS reset knob has a key interface configured for the insertion and rotation of a key therein for manually rotating the OS reset knob from its lock position to its unlock position.

4. The closure latch assembly of claim 3, wherein the key interface in the OS reset knob is configured to be located on a shut face portion of the vehicle door.

5. The closure latch assembly of claim 1, wherein the outside backup release mechanism has a reset knob biasing member biasing the OS reset knob toward its lock position.

6. The closure latch assembly of claim 5, wherein the reset knob biasing member acts on the OS backup lever to bias the OS backup lever toward its rest position.

7. The closure latch assembly of claim 6, wherein the OS backup lever has a spring flange on which the reset knob biasing member acts and the OS reset knob has a blocking lug segment configured to engage the spring flange to maintain the OS reset knob in its unlock position against the bias of the reset knob biasing member.

8. The closure latch assembly of claim 7, wherein the spring flange has a blocking edge and the blocking lug segment has a cam edge such that when the OS reset knob is in its lock position, engagement of the cam edge with the blocking edge releasably maintains the OS backup lever in its engaged position and OS reset knob in its lock position.

9. The closure latch assembly of claim 8, wherein the manual latch reset operation includes inserting the key into a key interface in the OS reset knob and manually rotating the OS reset knob from its lock position to its unlock position against a bias imparted by the reset knob biasing member and moving the cam edge out of engagement with the blocking edge for permitting the OS backup lever to automatically return to its rest position under a bias imparted by the reset knob biasing member.

10. The closure latch assembly of claim 1, wherein the latch mechanism further includes a secondary ratchet and a secondary pawl, the secondary ratchet being moveable between an engaged position whereat the secondary ratchet locates the primary pawl in its closed position and a disengaged position whereat the secondary ratchet moves the primary pawl to its open position, the secondary pawl being moveable between a closed position whereat the secondary pawl holds the secondary ratchet in its engaged position and an open position whereat the secondary pawl is located to permit the secondary ratchet to move to its disengaged position, wherein the release lever engages the secondary pawl and while the release lever is in the rest position the secondary pawl is located in its closed position and while the release lever is in the engaged position the release lever moves the secondary pawl to its open position.

11. A vehicle door having an outside handle and a closure latch assembly, comprising:

a latch mechanism having at least one ratchet and at least one pawl, the at least one ratchet being moveable between a striker capture position whereat the at least one ratchet retains a striker and a striker release position whereat the at least one ratchet releases the striker, the at least one pawl being moveable between a closed position whereat the at least one pawl holds the at least one ratchet in its striker capture position and an open position whereat the at least one pawl is positioned to permit the at least one ratchet to move to its striker release position;

a latch release mechanism having a release lever engaging the at least one pawl and being moveable between a rest position whereat the at least one pawl is located in its closed position and an engaged position whereat the release lever moves the at least one pawl to its open position; and an outside backup release mechanism having an OS backup lever, and OS connection device connecting the OS backup lever to a key cylinder associated with the outside handle, and an OS reset knob, the OS backup lever being moveable between a rest position and an engaged position causing corresponding movement of the release lever between the rest position and the engaged position, the OS reset knob being moveable between an unlock position permitting the OS backup lever to move to its rest position and a lock position whereat the OS reset knob holds the OS backup lever in its engaged position, wherein a manual latch release operation includes manually actuating the key cylinder to move the OS connection device and causing the OS backup lever to move from its rest position to its engaged position for moving the release lever to its engaged position so as to shift the closure latch assembly from a Latched mode into an Unlatched-Blocked mode with the OS reset knob in its lock position for blocking movement of the OS backup lever from its engaged position to its rest position and holding the release lever in its engaged position, wherein a manual latch reset operation includes shifting the closure latch assembly from its Unlatched-Blocked mode into an Unlatched-Reset mode, the manual latch reset operation includes manually moving the OS reset knob from its lock position to its unlock position for permitting the OS backup lever to return to its rest position and for permitting the release lever to return to its rest position.

12. The vehicle door of claim 11, further including a key cylinder configured for insertion and rotation of a key therein for causing the connection device to move the OS backup lever from its rest position to its engaged position.

13. The vehicle door of claim 12, wherein the manual latch reset operation includes inserting the key into a key interface in the OS reset knob and manually rotating the OS reset knob from its lock position to its unlock position.

14. The vehicle door of claim 13, wherein the key interface in the OS reset knob is configured to be located on a shut face portion of the vehicle door.

15. The vehicle door of claim 11, wherein the outside backup release mechanism has a reset knob biasing member biasing the OS reset knob toward its lock position.

16. The vehicle door of claim 15, wherein the reset knob biasing member acts on the OS backup lever to bias the OS backup lever toward its rest position.

17. The vehicle door of claim 16, wherein the OS backup lever has a spring flange on which the reset knob biasing member acts and the OS reset knob has a blocking lug segment configured to engage the spring flange to maintain the OS reset knob in its unlock position against the bias of the reset knob biasing member.

18. The vehicle door of claim 17, wherein the spring flange has a blocking edge and the blocking lug segment has a cam edge such that when the OS reset knob is in its lock position, engagement of the cam edge with the blocking edge releasably maintains the OS backup lever in its engaged position and OS reset knob in its lock position.

19. The vehicle door of claim 18, wherein the manual latch reset operation includes inserting the key into a key interface in the OS reset knob and manually rotating the OS reset knob from its lock position to its unlock position against a bias imparted by the reset knob biasing member and moving the cam edge out of engagement with the blocking edge for permitting the OS backup lever to automatically return to its rest position under a bias imparted by the reset knob biasing member.

20. The vehicle door of claim 11, wherein the at least one ratchet includes a primary ratchet and a secondary ratchet and the at least one pawl includes a primary pawl and a secondary pawl, the primary ratchet being moveable between a striker capture position whereat the primary ratchet retains the striker and a striker release position whereat the primary ratchet releases the striker, the primary pawl being moveable between a closed position whereat the primary pawl holds the primary ratchet in its striker capture position and an open position whereat the primary pawl is positioned to permit the primary ratchet to move to its striker release position, the secondary ratchet being moveable between an engaged position whereat the secondary ratchet locates the primary pawl in its closed position and a disengaged position whereat the secondary ratchet moves the primary pawl to its open position, the secondary pawl being moveable between a closed position whereat the secondary pawl holds the secondary ratchet in its engaged position and an open position whereat the secondary pawl is located to permit the secondary ratchet to move to its disengaged position, wherein the release lever engages the secondary pawl and while the release lever is in the rest position the secondary pawl is located in its closed position and while the release lever is in the engaged position the release lever moves the secondary pawl to its open position.

21. The closure latch assembly of claim 1, wherein blocking movement of the OS backup lever from its engaged position to its rest position prevents the release lever returning to its rest position from its engaged position.

22. A closure latch assembly for installation in a vehicle door, comprising:

a latch mechanism having a primary ratchet and a primary pawl, the primary ratchet being moveable between a striker capture position, whereat the primary ratchet retains a striker, and a striker release position, whereat the primary ratchet releases the striker, the primary pawl being moveable between a closed position, whereat the primary pawl holds the primary ratchet in its striker capture position, and an open position, whereat the primary pawl is positioned to permit the primary ratchet to move to its striker release position;

a latch release mechanism having a release lever being moveable between a rest position, whereat the primary pawl is located in its closed position, and an engaged position, whereat the release lever moves the primary pawl to its open position; and an outside backup release mechanism having an OS reset knob and an OS connection device connecting the OS reset knob to the release lever, the OS reset knob being moveable between an unlock position allowing the release lever to move from its engaged position to its rest position, and a lock position for preventing the movement of the release lever from its engaged position to its rest position wherein OS reset knob is biased towards its locked position;

wherein a manual latch release operation includes moving the OS connection device to move the release lever to the engaged position causing the OS reset knob to move to the lock position.

* * * * *